US011624204B2

(12) United States Patent
Schaeffer et al.

(10) Patent No.: US 11,624,204 B2
(45) Date of Patent: Apr. 11, 2023

(54) VERTICAL ROD ADJUSTMENT DEVICE

(71) Applicant: Sargent Manufacturing Company, New Haven, CT (US)

(72) Inventors: Timothy Schaeffer, North Haven, CT (US); Larry Cote, Coventry, CT (US); Darren C. Eller, Madison, CT (US)

(73) Assignee: Sargent Manufacturing Company, New Haven, CT (US)

( * ) Notice: Subject to any disclaimer, the term of this patent is extended or adjusted under 35 U.S.C. 154(b) by 573 days.

(21) Appl. No.: 16/801,043

(22) Filed: Feb. 25, 2020

(65) Prior Publication Data

US 2020/0270898 A1 Aug. 27, 2020

Related U.S. Application Data

(60) Provisional application No. 62/811,332, filed on Feb. 27, 2019.

(51) Int. Cl.

| | |
|---|---|
| ***E05B 15/00*** | (2006.01) |
| ***E05C 9/18*** | (2006.01) |
| ***E05B 63/00*** | (2006.01) |

(52) U.S. Cl.

CPC ..... *E05B 15/0013* (2013.01); *E05B 63/0056* (2013.01); *E05C 9/185* (2013.01); *E05Y 2900/132* (2013.01)

(58) Field of Classification Search

CPC ... E05C 9/00; E05C 9/006; E05C 9/04; E05C 9/042; E05C 9/043; E05C 9/046; E05C 9/10; E05C 9/14; E05C 9/16; E05C 9/18; E05C 9/1825; E05C 9/1833; E05C 9/1841; E05C 9/185; E05C 9/20; E05C 2009/1816; Y10T 403/7005; F16B 2200/403; F16B 2200/406; F16B 2/18; F16B 5/0628;

(Continued)

(56) References Cited

U.S. PATENT DOCUMENTS 2,368,713 A * 2/1945 Kane ..... F16B 5/10 411/552
4,181,334 A * 1/1980 Fusi ..... E05B 83/24 292/87

(Continued)

FOREIGN PATENT DOCUMENTS

DE 2206795 A1 * 8/1973
DE 2408311 A1 * 8/1975
WO WO-2008111109 A2 * 9/2008 ..... E05C 9/10

OTHER PUBLICATIONS

[No Author Listed] 2160(F) Concealed Vertical Rod Exit Devices Installation Instructions. Assa Abloy. https://content.assaabloyusa.com/doc/AADSS1089638&amp:.pdf, 16 pages, [publicly available at least as early as Feb. 25, 2020; last accessed May 13, 2020].

(Continued)

*Primary Examiner* — Alyson M Merlino
(74) *Attorney, Agent, or Firm* — Wolf, Greenfield & Sacks, P.C.

(57) ABSTRACT

A vertical rod coupler includes a bracket, bolt, and cam lock. The bolt is disposed through the bracket and the cam lock, and includes a head and a transverse pin. When the bolt is rotated relative to the cam lock, a pin camming surface cams the transverse pin to adjust the tension in the bolt and/or a distance between the head and the bracket.

20 Claims, 23 Drawing Sheets

(58) Field of Classification Search
CPC ..... E05B 79/16; Y10S 292/53; Y10S 292/54; Y10S 292/60
See application file for complete search history.

(56) References Cited

U.S. PATENT DOCUMENTS 4,601,499 A * 7/1986 Kim ..... E05C 9/20 292/DIG. 60
4,784,552 A * 11/1988 Rebentisch ..... F16B 37/046 403/348
4,830,531 A * 5/1989 Condit ..... F16B 37/045 403/348
5,042,851 A * 8/1991 Hunt ..... E05C 9/20 292/DIG. 60
6,733,202 B2 * 5/2004 Couture ..... F16B 5/0621 403/374.1
7,874,779 B2 * 1/2011 Csik ..... F16B 5/0208 411/553
2003/0185653 A1 * 10/2003 Csik ..... F16B 5/10 411/551
2010/0066101 A1 * 3/2010 Shen ..... E05B 65/1006 292/21
2019/0202329 A1 * 7/2019 James ..... B60N 2/897

OTHER PUBLICATIONS

[No Author Listed] Sargent Installation Instructions for LP8600 x LR8600 & 12-LP8600 x 12-LR8600 Series Low Profile Panic and Fire Exit Devices on Double Egress & Double Doors or LS8600 & 12-LS8600 Low Profile Exit Device on Single Door. Assa Abloy. https://content.assaabloyusa.com/doc/AADSS1055354&pdf, 6 pages, [dated Sep. 10, 2016; last accessed May 13, 2020].

* cited by examiner

VERTICAL ROD ADJUSTMENT DEVICE

CROSS-REFERENCE TO RELATED APPLICATIONS

This Application claims the benefit under 35 U.S.C. § 119(e) to U.S. Provisional Application Ser. No. 62/811,332, filed Feb. 27, 2019, entitled "VERTICAL ROD ADJUSTMENT DEVICE", which is herein incorporated by reference in its entirety.

FIELD

Disclosed embodiments are related to vertical rod adjustment device and related methods of use.

BACKGROUND

Vertical rod multi-point latching devices are traditionally used to secure a door at multiple latching points. Depending on the particular application, the vertical rods may be concealed inside of the door or attached to the outside of an interior surface of the door.

SUMMARY

In some embodiments a vertical rod coupler includes a bracket including a bracket through-hole, a bolt disposed in the bracket through-hole and including a head and a shaft, where the shaft includes a transverse pin, and a cam lock including a cam lock through-hole and a pin camming surface. The cam lock through-hole is configured to receive the shaft, and the pin camming surface is configured to cam the transverse pin to adjust a tension force in the shaft when the shaft is rotated. The bracket and the cam lock are configured to apply a clamping force to a vertical rod, wherein the clamping force is based at least partly on the tension force.

In some embodiments, a vertical rod coupler includes a bracket including a bracket through-hole, a bolt disposed in the bracket through-hole and including a head and a shaft, where the shaft includes a transverse pin, and a cam lock including a cam lock through-hole and a pin camming surface. The cam lock through-hole is configured to receive the shaft, and the pin camming surface is configured to cam the transverse pin to adjust a distance between the head and the bracket when the shaft is rotated. The bracket and the cam lock are configured to apply a clamping force to a vertical rod, wherein the clamping force is based at least partly on the distance.

In some embodiments, a vertical rod latching device for a door includes a latch movable between an engaged and disengaged position, an actuator movable between an actuated and an unactuated position, where in the actuated position the actuator moves the latch to the disengaged position and in the unactuated position the actuator moves the latch to the engaged position, a vertical rod configured to transmit reciprocal force, and a vertical rod coupler configured to selectively couple the actuator to the vertical rod. The vertical rod coupler includes a bolt movable between a first rotational position and a second rotational position. When the bolt is in the first rotational position the vertical rod is decoupled to the actuator, and when the bolt is in the second rotational position the vertical rod is coupled to the actuator.

In some embodiments, a method of adjusting a vertical rod multi-point latching device includes rotating a bolt of a vertical rod coupler to a first rotational position to decouple a vertical rod from an actuator of the multi-point latching device, allowing the vertical rod to move under force of gravity, and rotating the bolt of the vertical rod coupler to a second rotational position to coupler the vertical rod to the actuator.

In some embodiments, a vertical rod assembly for a door latch having an actuator includes a latch configured to engage with a door frame, a vertical rod attached to the latch, where the vertical rod is configured to actuate the latch upon actuation of the actuator, and a vertical rod coupler configured to selectively couple the vertical rod at least indirectly to the door actuator. The vertical rod coupler is releasably clampable to the vertical rod, where in an unclamped position of the coupler, the vertical rod is movable relative to the coupler to allow for a vertical height adjustment of the vertical rod, and where in a clamped position of the coupler, the vertical rod is in a fixed position relative to the coupler.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
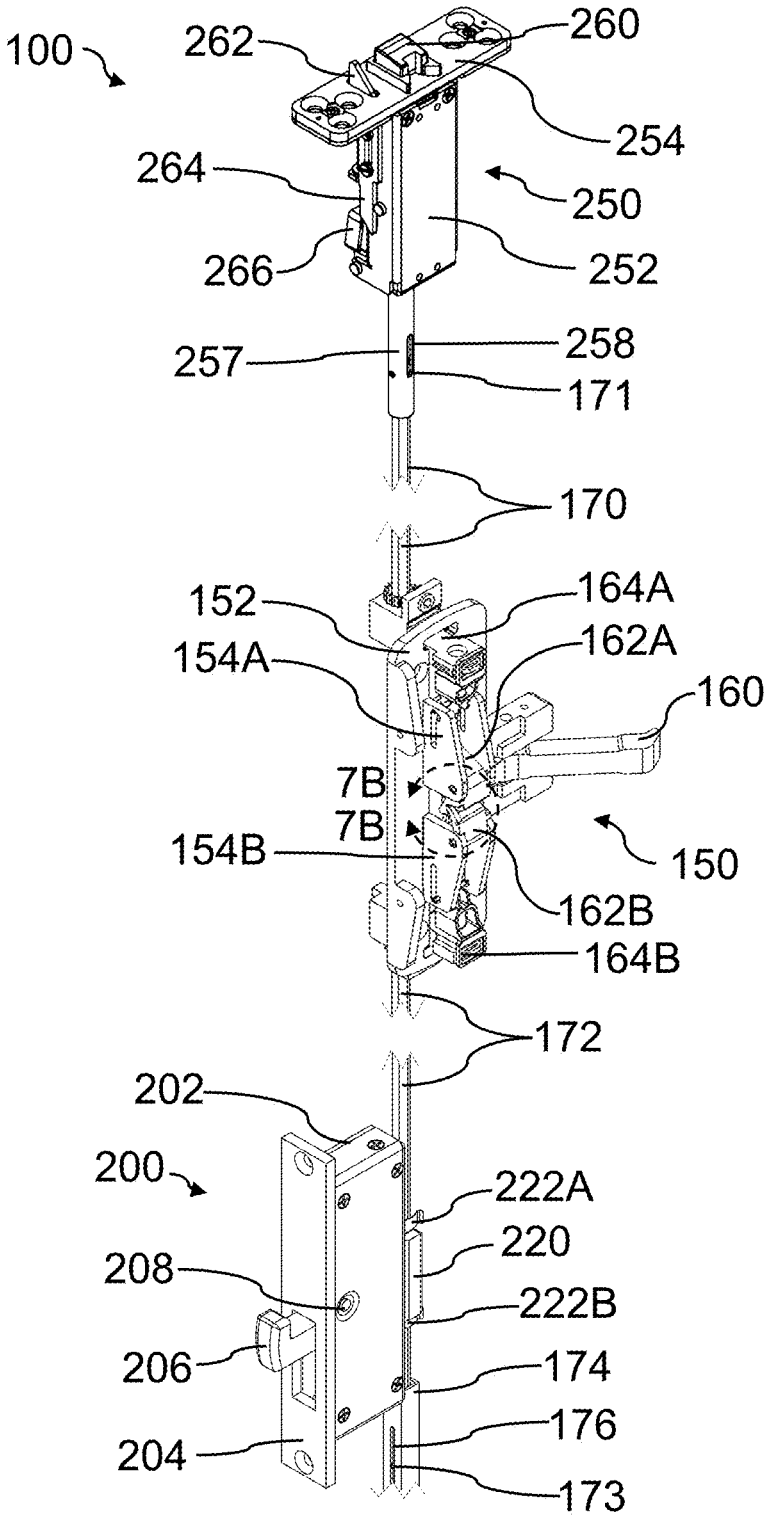
FIG. 1 is a perspective view of one embodiment of a multi-point latching device including a side latch.

Traditionally, multi-point latching devices are employed in doors to provide additional security or strength. These conventional locks employ vertical rods or tethers linked to a central actuator by which a user can operate multiple latches with the same actuator. The vertical rods may be attached to the exterior of an interior door surface, or may be concealed inside of the door. Typically, these locks include a transom latch, a jamb latch, and a threshold latch providing three point fastening for the door which is suitable for high security environments or environments with high wind and the associated risks of pressure and windborne objects impacting the secured door. In some cases, when rods for actuating the various latches are concealed in the door, they are hard to access for installation or normal maintenance. Many rod-based actuators require that an operator fully remove a door from a doorway to be able to adjust the position of vertical rods for installation or maintenance.

In view of the above, the inventors have recognized the benefits of a vertical rod adjustment device which allows the relative position of concealed rods to be changed from a central actuator. Additionally, the inventors have recognized the benefits of a vertical rod adjustment device which allows vertical rods to self-adjust based on passive forces applied by gravity and biasing members associated with various latches of the multi-point latching device. Such arrangement may allow a vertical rod multi-point latching device to be adjusted in a door frame without removing the door, or otherwise simplify installation and adjustment of a vertical rod latching device.

In some embodiments, a vertical rod coupler may be used to quickly and easily adjust a vertical rod of a multi-point latching device with a single turn. The vertical rod coupler may be loosened and tightened to modify a normal force (corresponding to a resultant frictional force) applied to the vertical rod to secure the vertical rod to an actuator which moves the vertical rod in a reciprocating motion to move a latch between an engaged position and a disengaged position. According to exemplary embodiments herein, a single bolt of the vertical rod coupler may be loosened or tightened by less than a half-turn (i.e., less than 180 degrees) to correspondingly decouple or couple the vertical rod to the actuator. In some embodiments, a vertical rod coupler includes a bolt, a bracket, and a cam lock. The bolt may extend through the bracket and the cam lock and may include a head adjacent the bracket and a traverse pin adjacent the cam lock so that the bracket and cam lock are secured on a shaft of the bolt. The cam lock may include a pin camming surface configured to engage the transverse pin when the bolt is rotated between a first rotational position and a second rotational position. The bolt may be rotated between the first rotational position and second rotational position to adjust a tension force in the bolt, which in turn adjusts a clamping force applied to a vertical rod disposed between the bracket and the cam lock. The rotation of the bolt may also adjust a distance between the head of the bolt and the bracket. The first rotational position and the second rotational position may correspond to the vertical rod being decoupled from the actuator and the vertical rod being coupled to the actuator, respectively. The first and second rotational positions may be spaced from one another by about 90 to 135 degrees.

In some embodiments, a multi-point latching device which may be actuated by an exit device, handle, or other suitable interface includes an actuator, a transom latch, and a side or bottom latch. The actuator may be operatively coupled to the transom latch and the side or bottom latch so that the transom latch and side or bottom latch may be operated concurrently by a single actuation of the actuator. Accordingly, in some embodiments, the actuator may be connected to the transom latch by a first (i.e., upper) vertical rod and the side or bottom latch connected to the side or bottom latch by a second (i.e., lower) vertical rod. The first rod and second rod may be configured to move substantially linearly along a first axis and a second axis, respectively. Accordingly, when the actuator is actuated by a user, the first rod and second rod may be moved linearly along their respective axes to operate the transom latch and side or bottom latch.

In some cases, the relative position of the first and second rods (e.g., vertical rods) may affect the operability of the multi-point exit device. That is, if a vertical rod is misaligned with the actuator, associated latches operated by the vertical rod may project too far, not enough, or otherwise inhibit successful, repeatable operation of the door. Traditionally, vertical rods are carefully adjusted by an operator installing or maintaining the multi-point latching device using a combination of set screws and threaded rod couplings which make the user loosen and tighten hard to reach fasteners multiple times before a successful alignment is reached. Furthermore, these traditional systems for adjustment are inaccessible when a door is hung in a door frame. According to exemplary embodiments herein, when a vertical rod coupler is loosened and a vertical rod of a multi-point latching device is decoupled from an actuator, the vertical rod may slide relative to the vertical rod coupler under force of gravity or a biasing member of the multi-point latching device.

Accordingly, the vertical rod coupler may be loosened to allow the vertical rod to self-adjust relative to an actuator of the multi-point latching device without direct input from an operator. In some embodiments, a vertical rod coupler includes a bolt, a bracket, and a cam lock. As noted previously, the bolt may be rotated to adjust a tension force applied to a vertical rod captured between the bracket and cam lock to couple or decouple the vertical rod from an actuator. In some embodiments, the bracket may include at least one channel configured to slidably retain the vertical rod between the bracket and the cam lock so that when the vertical rod coupler is loosened and the vertical rod is decoupled, it may slide and move relative to the vertical rod coupler while remaining captured in the vertical rod coupler. As the vertical rod and vertical rod coupler are able to slide relative to one another, the associated latches and actuators of a multi-point latching device may be moved to a particular state independently so that each of the latches and actuator are aligned in that state while the door is hung in a door frame. For example, biasing members and/or gravity may urge a transom latch to an engaged (i.e., extended) position, an actuator to an unactuated position, and a bottom latch to an engaged (i.e., extended) position which are properly aligned for a particular door. Accordingly, the vertical rods and actuator may be automatically aligned while the vertical rods are decoupled relative to the actuator. Once the vertical rods and actuator have settled into aligned positions, the vertical rod couplers may be tightened to couple to the vertical rods to the actuator. Thus, the vertical rod coupler of exemplary embodiments described herein may allow vertical rods to be quickly and easily adjusted relative to an actuator with minimal manipulation of fasteners and set screws and while the door remains hung in a door frame.

It should be noted that exemplary embodiments described herein may be employed in any suitable vertical rod latching device having any suitable number of latches, including transom latches, side latches, and bottom latches. Additionally, a vertical rod coupler may be employed in a lock having a single concealed rod or multiple concealed rod. A vertical rod coupler may also be employed with locks actuated by exit devices, handles, deadbolt handles, and/or any other suitable actuator. Additionally, in some embodiments the rod coupler may be employed with horizontal rods, inclined rods, or rods in any desirable orientation, as the present disclosure is not so limited.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a perspective view of one embodiment of a multi-point latching device 100 including an actuator 150, a side latch 200, and a transom latch 250. As shown in FIG. 1, a first rod 170 operatively couples the actuator to the transom latch 250 and a second rod 172 operatively couples the actuator to the side latch 200. According to the depicted embodiment, the multi-point latching device is configured to be mounted inside of the door (not shown in FIG. 1), so that a majority of the components are substantially concealed from view. Of course, the multi-point latching device may visible or partially concealed, as the present disclosure is not so limited. As shown in FIG. 1, the multi-point latching device is arranged with the first and second rods in a vertical orientation, with the transom latch configured to engage a door transom and the side latch configured to engage a door jamb. As the transom latch and side latch are both linked to the same centralized actuator, the transom latch and side latch may be actuated concurrently to selectively secure or release a door.

According to the embodiment shown in FIG. 1, the actuator 150 includes a chassis 152, a lever 160, a first cam 162A coupled to a first rod holder 164A, and a second cam 162B coupled to a second rod holder 164B. In other embodiments, the first rod holder and second rod holder may be configured as vertical rod holders similar to the embodiments described with reference to FIGS. 16-25. The lever is rotatably mounted to the chassis 152 and is configured to rotate about an axis which is parallel with a longitudinal axis of the first rod 170 and second rod 172. The first cam and second cam are also rotatably mounted to the chassis and are held by first guide wall 154A and second guide wall 154B, respectively, such that both of the cams rotate about an axis substantially orthogonal to the rotational axis of the lever. The first rod holder 164A is configured to secure the first rod 170 to the actuator, and is slidably mounted to the chassis so that the first rod may be moved along its longitudinal axis (i.e., a first axis) Likewise, the second rod holder 164B is configured to secure the second rod 172 to the actuator and is slidably mounted to the chassis to allow the second rod to be moved along its longitudinal axis (i.e., a second axis). The first rod holder is coupled to an end of the first cam so that rotational motion of the first cam causes linear motion of the first rod holder along the first axis. The second rod holder is coupled to an end of the second cam so that rotational motion of the second cam causes linear motion of the second rod holder along the second axis. As will be discussed further with reference to FIGS. 4-5, when the lever is rotated (i.e., actuated), the lever engages at least one of the first cam and the second cam to rotate the first and second cams in opposite directions. As the first and second cams are coupled to the first and second rod holders, respectively, the first rod holder is moved in a first direction along the first axis and the second rod holder is moved in a second direction along the second axis as the cams are rotated. According to the embodiment shown in FIG. 1, the first direction and second direction may be opposite one another such that the first rod holder and second rod holder are moved closer to one another when the lever is actuated (e.g., rotated).

As shown in FIG. 1, the side latch 200 includes a chassis 202, a face plate 204 and a hook latch head 206. The chassis is configured to fit into a mortise opening formed in a door, and may be secured to the door by the face plate. The hook latch head is rotatably mounted to the chassis via hook latch head pin 208. As shown in FIG. 1, the side latch is coupled to the second rod 172 by a rod coupler 220 which fits around the second rod. Spring clips 222A, 22B, releasably secure the second rod inside the rod coupler. As will be discussed further with reference to FIGS. 10-11, the rod coupler transmits longitudinal motion of the second rod into rotational motion of the hook latch head, so that movement of the second rod along the second axis may move the hook latch head between an engaged position and a retracted position. In the state shown in FIG. 1 the hook latch head is in an engaged position, projecting past the face plate 204 so that the hook latch head would engage an associated door jamb when adjacent a hook latch head receptacle. According to the embodiment of FIG. 1, the second rod 172 is disposed partially in a rod guide 174. The second rod guide includes a rod guide slot 176 which receives a second rod pin 173 disposed on the second rod. The second rod guide substantially constrains the second rod to linear movement along the second axis (i.e., the longitudinal axis of the second rod).

According to the embodiment of FIG. 1, the side latch may be disposed below a centerline of a door such that the door may be secured at different portions of the door (e.g., top and bottom portions). Without wishing to be bound by theory, the distance of the side latch head from the top of the door may at least partially determine the amount of deflection of a door place under pressure or impact loads. Accordingly, in some embodiments, the hook latch head of a side latch may positioned below a top of a door by a distance greater than ½ of the door length, ⅝ of the door length, ⅔ of the door length, ¾ of the door length, or any other appropriate distance. Correspondingly, the hook latch head may be positioned below a top of a door by a distance of less than ⅝ of the door length, ⅔ of the door length, ¾ of the door length, the door length, of any other appropriate distance. Combinations of the above noted ranges are contemplated, as the present disclosure is not so limited.

As shown in FIG. 1, the transom latch 250 includes a chassis 252, a face plate 254, a latch head 260, and a trigger 262. The latch head 260 may be directly coupled to the first rod 170 so that movement of the first rod along the first axis (i.e., a longitudinal axis of the first rod) moves the latch head between an engaged and disengaged position. According to the depicted embodiment, the latch head 260 does not include a substantially inclined face, and will therefore not automatically retract when the latch head contacts a transom strike plate. In order to prevent interference or premature engagement of the latch head with a transom strike plate, the transom latch includes a lockout 266 which is controlled by the trigger 262. According to the embodiment of FIG. 1, the lockout is configured to allow movement of the latch head toward a disengaged position (i.e., where the latch head is substantially retracted to clear a transom strike plate without interference). However, the lockout is configured to prevent movement of the latch head toward an engaged position (i.e., where the latch head is substantially extended to engage a transom strike plate). Accordingly, when the transom latch head is retracted the lockout will retain the transom latch head in the disengaged position so that the transom latch head does not interfere with door opening or closing. The trigger 262 is configured to move between an extended position and a retracted position and includes an inclined face which is suitable to automatically retract the trigger when the trigger contracts a transom strike plate. As shown in FIG. 1, the trigger is configured to engage the lockout when the trigger is moved to the retracted potion with a lockout engagement portion 264 configured as a camming surface. When the trigger engages the lockout (e.g., along a camming surface) the lockout may release the transom latch head 260 so that the latch head may move to the engaged position to secure the door once the door is closed. Thus, the latch head and trigger arrangement shown in FIG. 1 may allow for automatic latching of the transom latch head without inclusion of an inclined face on the transom latch head. According to the embodiment shown in FIG. 1, the chassis 252 is coupled to a transom rod guide 257 which includes a transom rod guide slot 258 with receives a first rod pin 171 disposed on the first rod to substantially constrain the movement of the first rod to linear movement along the first axis (i.e., the longitudinal axis of the first rod).

Figure 2:
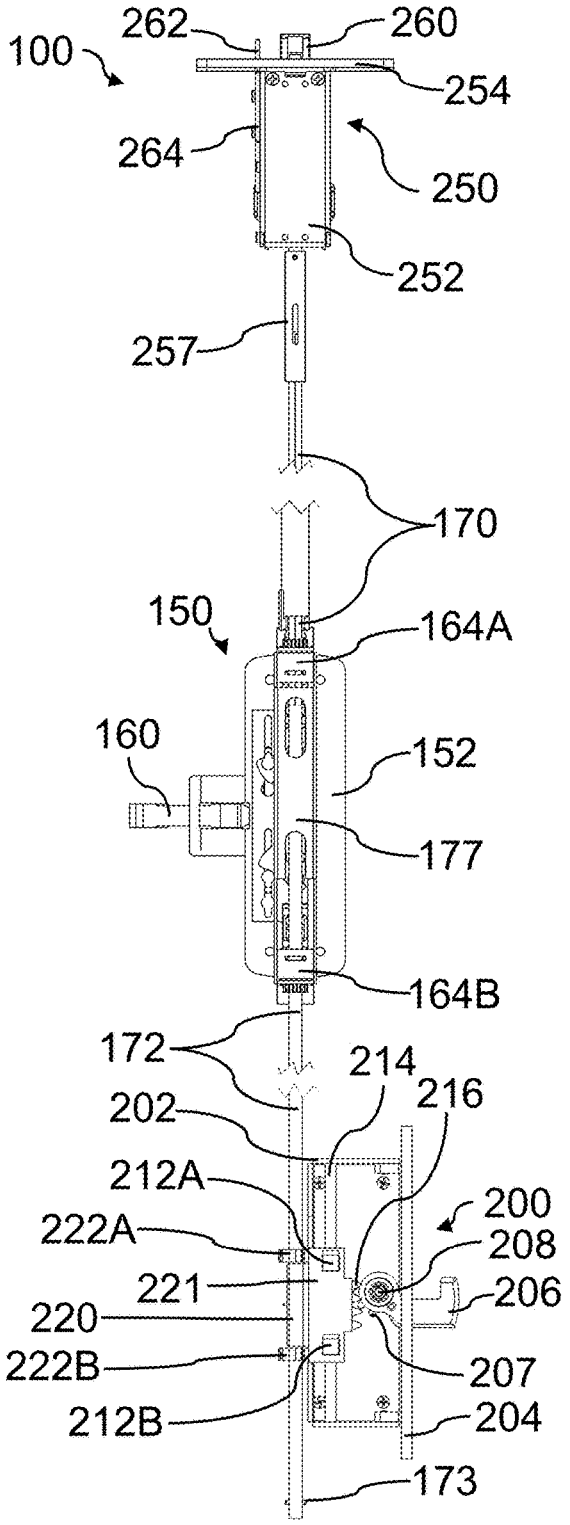
FIG. 2 is a rear elevation view of the multi-point latching device of FIG. 1.

FIG. 2 is a rear elevation view of the multi-point latching device 100 of FIG. 1. As shown in FIG. 2, the rear panel of the side latch 200 has been removed to show the internal components of the side latch. As discussed previously, the side latch includes a hook latch head 206 rotatably coupled to a chassis by a hook latch head pin 208 and a rod coupler 220 operatively coupled to the second rod 172 so that linear movement of the second rod is converted into rotational motion of the hook latch head. As shown in FIG. 2, the hook latch head includes a plurality of gear teeth 207 disposed in an arc in a circumferential arrangement around the hook latch head pin 208. Correspondingly, the rod coupler includes a slide body 221 which includes a plurality of gear teeth 216 configured to mesh with the teeth of the hook latch head. As shown in FIG. 2, the slide body 221 is disposed around guide rail 214 so that the slide body is constrained to move in a linear direction along the guide rail parallel to the longitudinal axis of the second rod. Accordingly, the rod coupler forms a rack and the hook latch head forms a pinion so that linear movement of the second rod is converted into rotational movement of the hook latch head which may be used to move the hook latch head between the hook engaged and hook disengaged positions.

As shown in FIG. 2, the actuator 150 also includes a rear actuator rod guide 177 which is configured to substantially constrain the first rod 170 and first rod holder 164A as well as the second rod 172 and second rod holder 164B to linear movement along the first axis of the first rod and second axis of the second rod, respectively. Accordingly, the actuator may use camming motions to precisely and reliably move the first and second rods along their longitudinal axis to actuate the transom latch and side latch.

Figure 3:
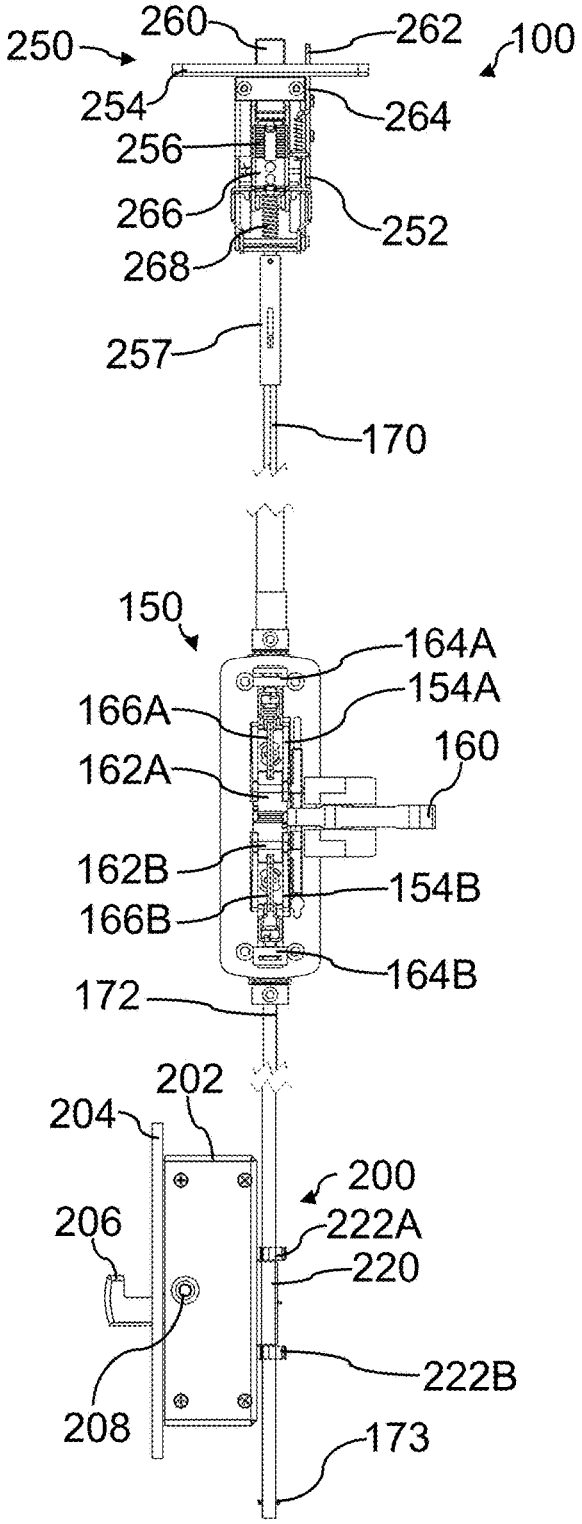
FIG. 3 is a front elevation view of the multi-point latching device of FIG. 1.

FIG. 3 is a front elevation view of the multi-point latching device 100 of FIG. 1. As discussed previously, the actuator 150 includes a lever 160, a first cam 162A, a second cam 162B which cooperate to move the first rod 170 and second rod 172 along the first axis and second axis, respectively. As shown in FIG. 3, the first cam is coupled to the first rod holder 164A by a first linkage 166A and the second cam is coupled to the second rod holder by a second linkage 166B. The first and second cam linkages are rotatably linked (e.g., by a linkage pin) to both their respective cams and rod holders so that the rotational motion of the cams may be converted into linear motion of the rod holders.

As discussed previously, the transom latch includes a trigger 262 and a lockout 266 which cooperate to allow the latch head 260 to automatically extend into a transom strike plate without interference when the door is being opened or closed. As shown in FIG. 3, the lockout 266 interfaces with a plurality of ratchet teeth 256 so that the latch head 260 is progressively retained at it is moved to the disengaged (i.e., retracted) position. When the trigger 262 is moved from the extended position shown in FIG. 3 to the retracted position, the lockout engagement portion 264 cams the lockout out of engagement with the ratchet teeth so that the latch head 260 may move to toward the engaged position. Of course, while ratchet teeth are employed in the depicted embodiment, any suitable progressive or non-progressive retaining element may be employed, as the present disclosure is not so limited. As shown in FIG. 3, the transom latch includes a biasing member configured as a compression spring which urges the latch head toward the engaged position. Accordingly, when released by the trigger, the latch head may automatically move to the engaged position under influence of the compression spring. Of course, while a compression spring is employed in the embodiment of FIG. 3, any suitable biasing member may be employed as the present disclosure is not so limited.

According to the embodiment shown in FIG. 3, the biasing member 268 may apply an urging force to the first rod 170 so that the first rod is urged to a position which corresponds to the transom latch head 260 being in an engaged position. As the urging force is transmitted through the first rod to the actuator and from the actuator to the side latch through the second rod, the hook latch head 206 may also be urged toward a hook engaged position. Thus, the linkage of the first rod and second rod through the actuator may allow a single biasing member to be employed in any one of the transom latch, actuator, and side latch. Such an arrangement may be beneficial to simplify installation and reduce parts and cost.

Figure 4:
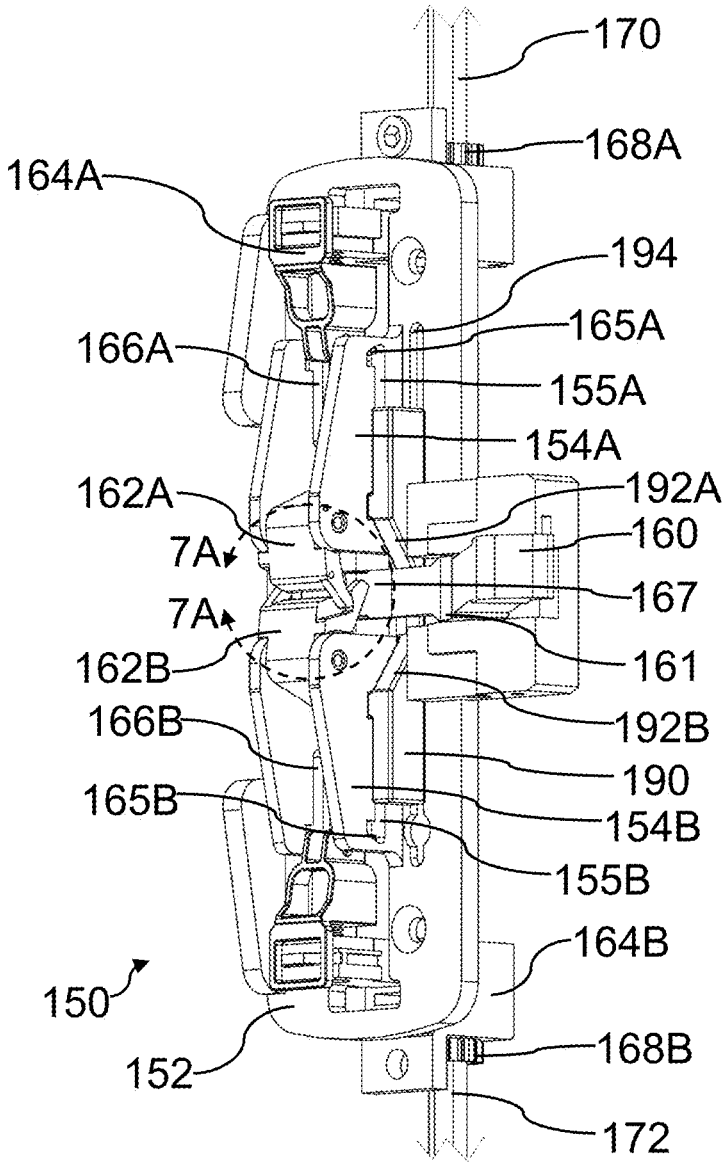
FIG. 4 is a perspective view of one embodiment of an actuator for the multi-point latching device of FIG. 1.

FIG. 4 is a perspective view of one embodiment of an actuator 150 for the multi-point latching device of FIG. 1. As discussed previously, the actuator is configured to allow a first rod 170 and a second rod 172 to move concurrently along a first axis (corresponding to a longitudinal axis of the first rod) and a second axis (corresponding to a longitudinal axis of the second rod), respectively. As best shown in FIG. 4, the lever 160 is rotatably mounted to the chassis by a hinge portion 161. A cam engagement portion 167 of the lever engages both the first cam 162A and the second cam 162B. The first cam and second cam are rotatably mounted to a first guide wall 154A and a second guide wall 154B, respectively. Accordingly, when the lever is rotated about the hinge portion, the cam engagement portion 167 will engage both the first cam and second cam to rotate the cams in opposite directions about parallel axes. The first cam is coupled to a first rod holder 164A by a first linkage 166A which converts the rotational motion of the cam to linear motion of the first rod holder. The first rod holder and first linkage are at least partially disposed in a first linkage slot 155A formed in the first guide wall 154A which at least partially constrains to the first linkage and first rod holder to linear movement. Similarly, the second cam is coupled to a second rod holder 164B by a second linkage 166B which is disposed at least partially in second linkage slot 155B formed in the second guide wall. According to the embodiment shown in FIG. 4, when the lever is rotated about the hinge portion 161, the cams draw the first rod holder and second rod holder closer together, thereby applying tension through the rods to a transom latch and/or side latch. Of course, in other embodiments, the cams may rotated to move the first rod holder and second rod holder further apart to apply compression through the rods, as the present disclosure is not so limited. As shown in FIG. 4, the relative position of the first and second rods to the first and second rod holder may be adjusted by rotating a first adjustment nut 168A or a second adjustment nut 168B, respectively.

As shown in FIG. 4, the actuator also includes a slider 190 disposed in a slider slot 194 formed in the chassis 152 of the actuator. The slider includes a first inclined camming surface 192A and a second inclined camming surface 192B which are configured to selectively engage the lever 160 to rotate the lever. As will be discussed further with reference to FIG. 6, the slider 190 may be operatively coupled to an interior handle or other actuator so that the lever may be actuated from a side of the door from which the lever is not accessible. When the slider engages the lever, the lever may be cammed to correspondingly rotate the first and second cams 162A, 162B to actuate an associated lock with the first rod 170 and second rod 172. According to the embodiment of FIG. 4, the lever may be operatively connected to a user interfacing element such as a paddle, push bar, or other suitable arrangement so that a user may easily actuate the lever.

Figure 5:
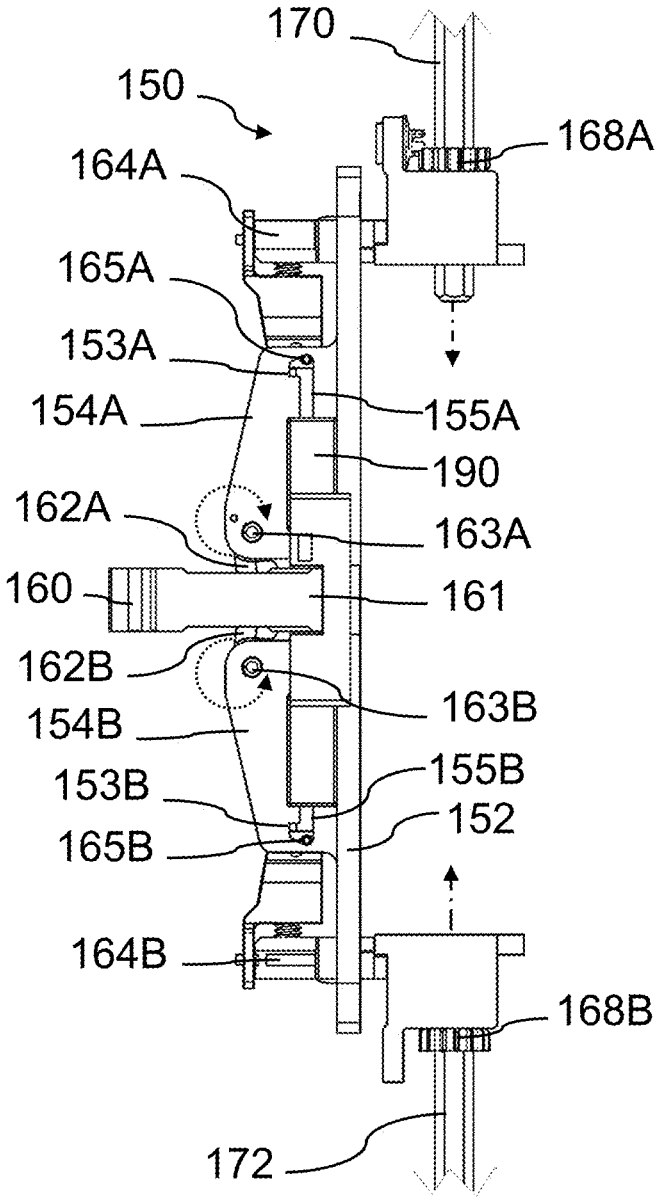
FIG. 5 is a right side elevation view of the actuator of FIG. 4.

FIG. 5 is a right side elevation view of the actuator 150 of FIG. 4. As best shown in FIG. 5, the first rod 170 and the second rod 172 are movable along their longitudinal axes by movement of the first rod holder 164A and second rod holder 164B, respectively. The first rod holder is constrained at least partially to linear movement by first linkage pin 165A which is disposed in the first linkage slot 155A and couples the first rod holder to the first linkage (see FIG. 4). Likewise, the second rod holder is constrained at least partially to linear movement by second linkage pin 165B which is disposed in second linkage slot 155B and couples the second rod holder to the second linkage (see FIG. 4). According to the embodiment shown in FIG. 5, the first and second rods have coincident axes (i.e., the longitudinal axes of both rods are coincident). Accordingly, when the lever 160 is actuated the first and second rods are moved toward or apart from one another along the same coincident axis. As shown in FIG. 5, the first cam 162A is rotatably coupled to the first guide wall 154A by first cam pin 163A and the second cam 162B is rotatably coupled to the second guide wall 154B by a second cam pin 163B. In the depicted embodiment, the first cam and second cam are configured to rotate equally in opposite directions about their respective axes when engaged by the lever 160. As shown by the dashed arrows, in this embodiment, the first cam rotates clockwise relative to the page to move the first rod holder in a first direction (see dot-dash arrow) while the second cam rotates in a counterclockwise direction relative to the page to move the second rod holder in a second direction (see long-dot-dash arrow, where the first direction and the second direction are opposite one another and move the first and second rod holders closer together). Correspondingly, when the cams rotate in opposite directions the first and second rods will move further apart along their coincident axes. According to the embodiment of FIG. 5, rotation of the lever by a user may move the first and second rods closer together along their coincident axes, applying tension through the rods to move any associated lock to a disengaged position.

According to the embodiment shown in FIG. 5, the actuator includes first and second deadlatching catches 153A, 153B formed as a part of the first linkage slot 155A and second linkage slot 155B. The deadlatching catches are configured to prevent movement of the first rod holder 164A or second rod holder 164B without direct actuation of the lever 160. That is, force applied directly to the first or second rods may cause the first linkage pin 165A and second linkage pin 165B to engage and abut against first deadlatching catch 153A and second deadlatching catch 153B, respectively. Thus, force which is externally applied to the multi-point latching device (e.g., to a transom latch head or a hook latch head) may not move the rods to release the door. If the actuator is properly actuated, rotation of the first cam 162A and the second cam 162B may draw the first pin and second pin out of the deadlatching catches and into the first linkage slot 155A and second linkage slot 155B. The direction of rotation of the first cam and the second cam may be suitable to draw the pin out of the deadlatching catch to allow the first rod holder and second rod holder to move toward one another to release the door upon direct actuation of the lever 160.

Figure 6:
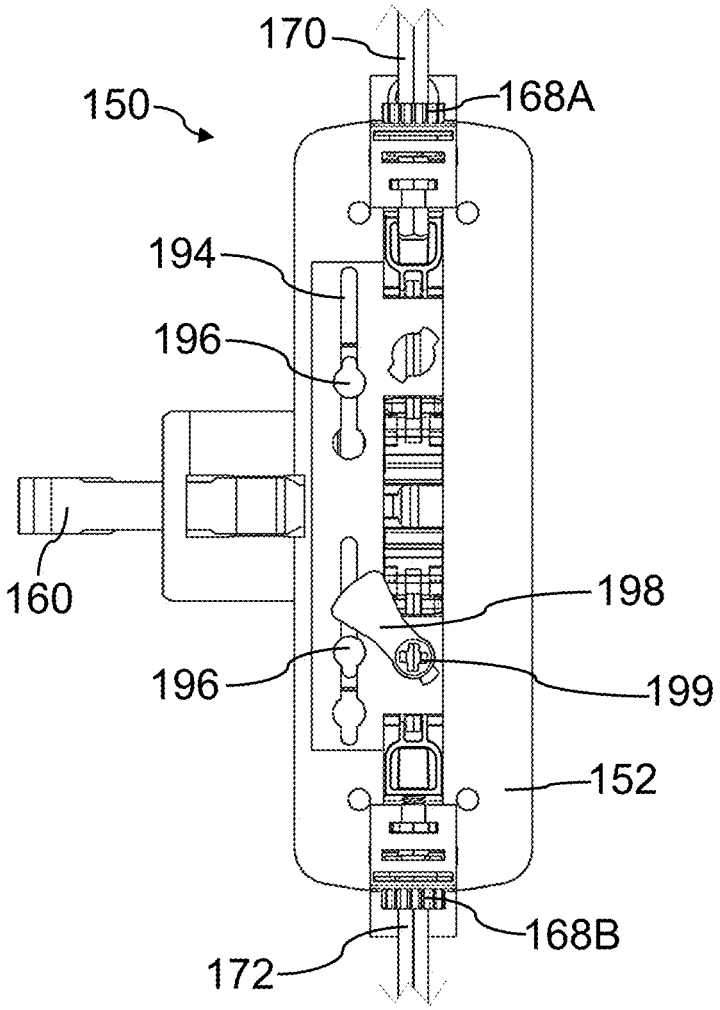
FIG. 6 is a rear elevation view of the actuator of FIG. 4.

FIG. 6 is a rear elevation view of the actuator 150 of FIG. 4. As best shown in FIG. 6, the actuator includes a handle mount 199 including a wing 198 configured to engage one of two tabs 196 of a slider (see FIG. 4). The tabs are disposed in slider slot 194. When an attached handle is turned, the wing 198 may engage one of the tabs 196 to slide the slider in the slider slot 194. As discussed previously, this movement may cause an inclined camming surface of the slider to engage the lever 160 to actuate the multi-point latching device (e.g., by moving the first rod holder and second rod holder toward one another). Of course, while a handle attachment and wing are shown in FIG. 6, any suitable arrangement may be employed to allow the multi-point latching device to be actuated from a side of the door where the lever is not accessible.

Figure 7A:
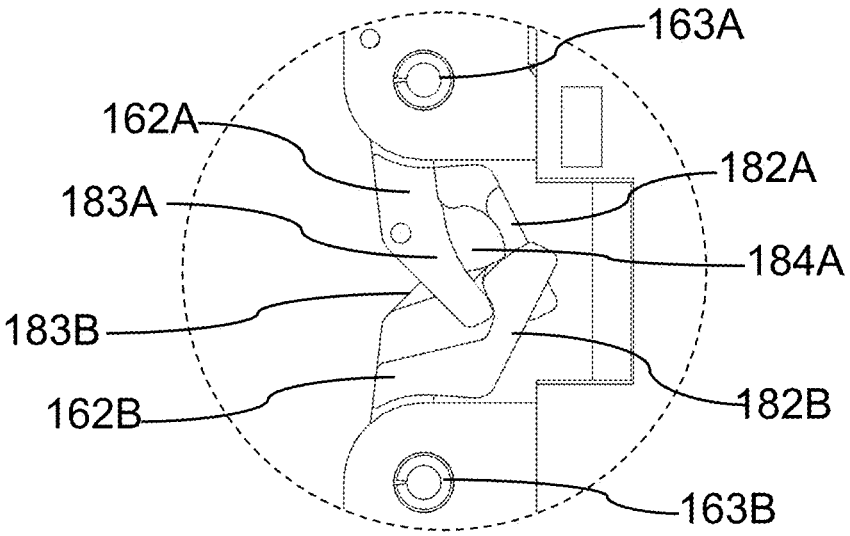
FIG. 7A is an enlarged right side view of section 7A of FIG. 4.
Figure 7B:
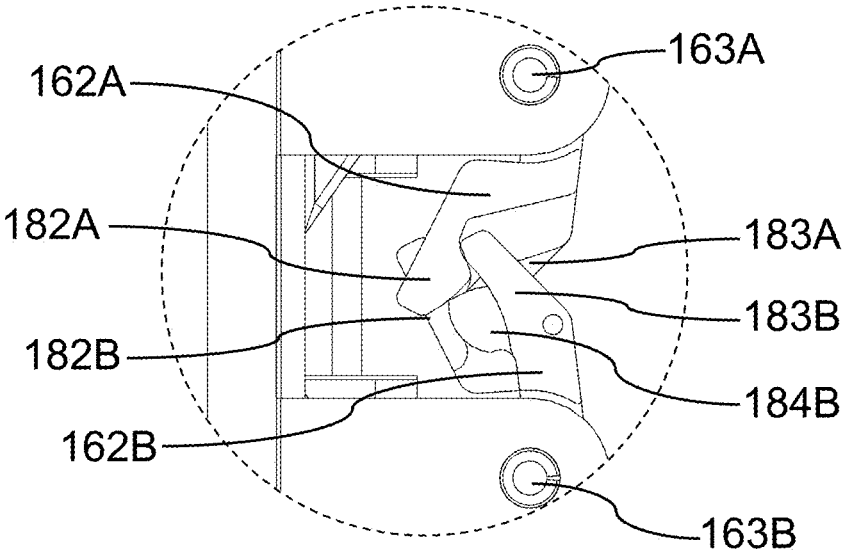
FIG. 7B is an enlarged left side view of section 7B of FIG. 1.

FIG. 7A is an enlarged right side view of section 7A of FIG. 4 and FIG. 7B is an enlarged left side view of section 7B of FIG. 1 depicting first cam 162A and second cam 162B with the lever removed for clarity. As shown in FIG. 7A, the first cam includes a first cam lobe 184A, a first upper arm 183A, and a first lower arm 182A. Similarly, as shown in FIG. 7B, the second cam includes a second cam lobe 184B, a second upper arm 183B, and a second lower arm 182B. As shown in FIG. 7A, the first upper arm engages the second lower arm. As shown in FIG. 7B, the second upper arm engages the first lower arm. Accordingly, the first and second cams are intermeshed and will rotate together about the first cam pin 163A and second cam pin 163B, respectively. That is, even in the case of misalignment of the lever so that the lever only engages one of the cam lobes, the cams will rotate concurrently so that the coupled rod holders will also move concurrently. Additionally, forces transmitted from one rod holder another rod holder may be transmitted through the intermeshed cams without interference or input of the lever. Thus, the intermeshed cam may provide reliable concurrent actuation of the multi-point latching device.

Figure 8:
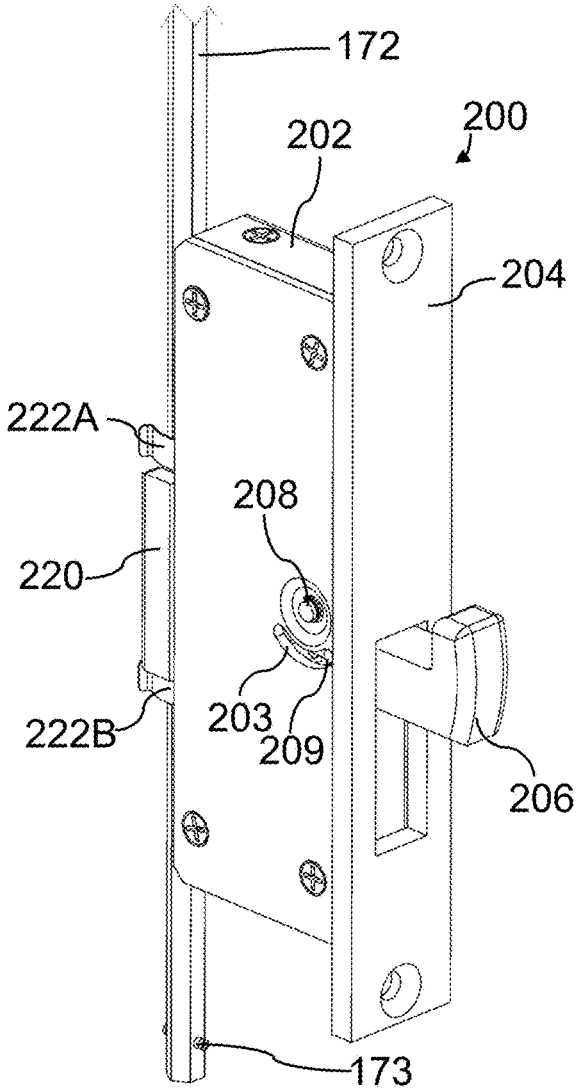
FIG. 8 is a perspective view of one embodiment of a side latch for the multi-point latching device of FIG. 1.

FIG. 8 is a perspective view of one embodiment of a side latch 200 for the multi-point latching device of FIG. 1. As discussed previously, the side latch includes a hook latch head 206 which is configured to rotate between a hook engaged position and a hook disengaged position. The hook latch head is rotatably mounted to the chassis 202 via a hook latch head pin 208. Additionally, as shown in FIG. 8, the chassis includes a hook latch head slot 203 which receives a hook latch head guide 209. In addition to guiding the hook latch head through rotational motion, the hook latch head slot 203 may also be used to set predetermined limits on the range of rotation of the hook latch head. That is, the hook latch head slot may determine the range of motion of the hook latch head so that the hook latch head may be reliably moved between the hook engaged and hook disengaged position to secure a door.

Figure 9:
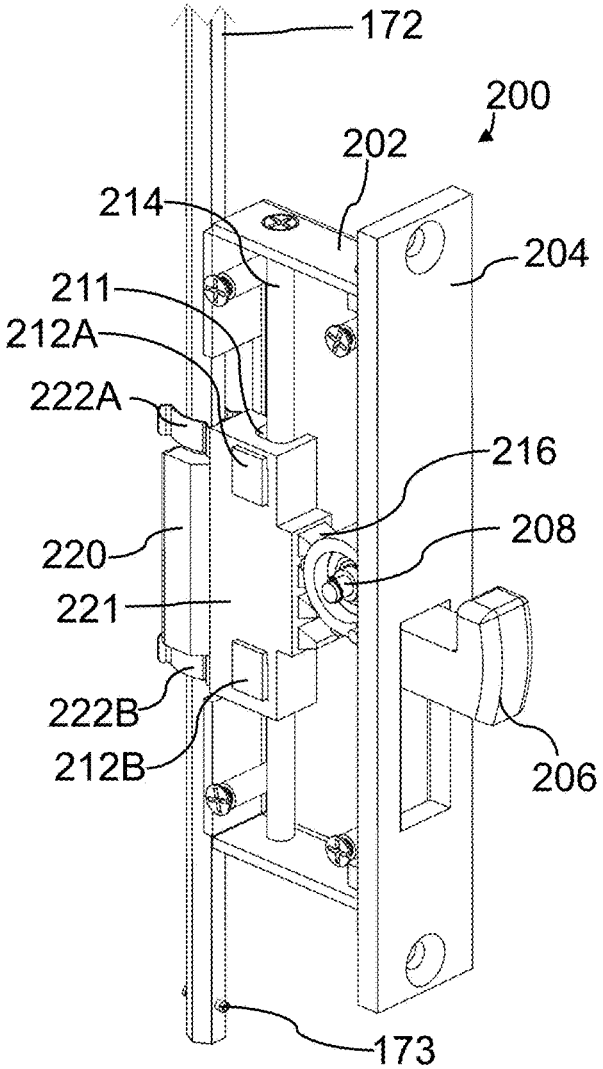
FIG. 9 is a perspective view of the side latch of FIG. 8 with a cover removed.

FIG. 9 is a cutaway perspective view of the side latch 200 of FIG. 8 with a portion of the chassis 202 removed to show the internal components of the side latch. As discussed previously, the side latch includes a rod coupler 220 and a hook latch head 206. The rod coupler includes a slide body 221 which receives linear motion of second rod 172 and converts it into rotary motion of the hook latch head via gear teeth 216. As best shown in FIG. 9, the slide body 221 is slidably coupled to the chassis 202 via a guide rail 214 disposed in a guide channel 211 formed in the slide body. The guide rail is secured in the guide channel 211 with a first clip 212A and a second clip 212B which secure the slide body to the guide rail but allow the slide body to move with second rod 172 to move the hook latch head between the hook engaged position and the hook disengaged position.

Figure 10:
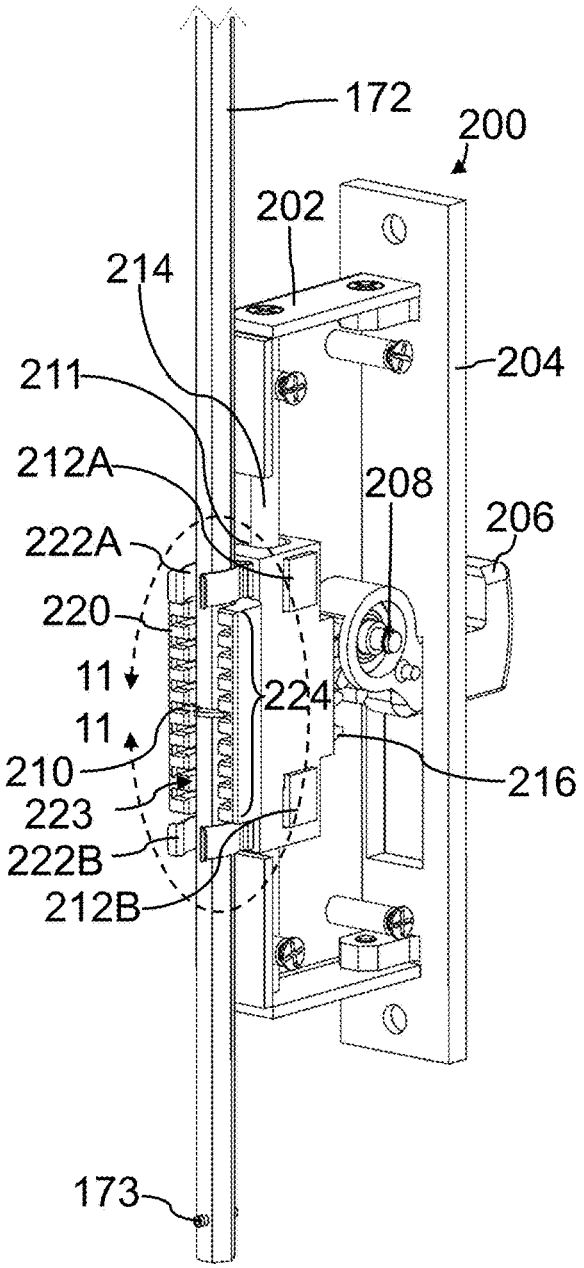
FIG. 10 is another perspective view of the side latch of FIG. 8 with a cover removed.

FIG. 10 is another cutaway perspective view of the side latch 200 of FIG. 8 showing the interface between the rod coupler 220 and the second rod 172. As shown in FIG. 10, the rod coupler includes a channel 223 which is formed to accommodate the second rod. The rod coupler also includes a first spring clip 222A and a second spring clip 222B which releasably secure the second rod 172 in the channel. The rod coupler also includes a plurality of grooves 224 which are formed in a transverse direction across the channel 223. The grooves are each configured to receive a retaining ring 210 which is attached to the second rod. The retaining ring may be releasably secured to an annular groove in the second rod so that the retaining ring may be used to transmit longitudinal force from the second rod. When the retaining ring is disposed in one of the grooves, force may be transmitted from the second rod to the rod coupler and vice versa via the interface between the groove and retaining ring. The spring clips 222A, 222B keep the retaining ring secure in the groove. Without wishing to be bound by theory, providing a plurality of grooves may allow for simplified installation of the side latch into a door. As will be discussed further with reference to FIG. 11, rather than adjusting the position of the retaining ring or second rod which may be concealed in a door, the side latch may be pushed into a mortise opening and the retaining ring will align with and engage the nearest groove of the plurality of grooves 224. Thus, minimal adjustment of the rod or the side latch may be necessary to install the side latch.

Figure 11:
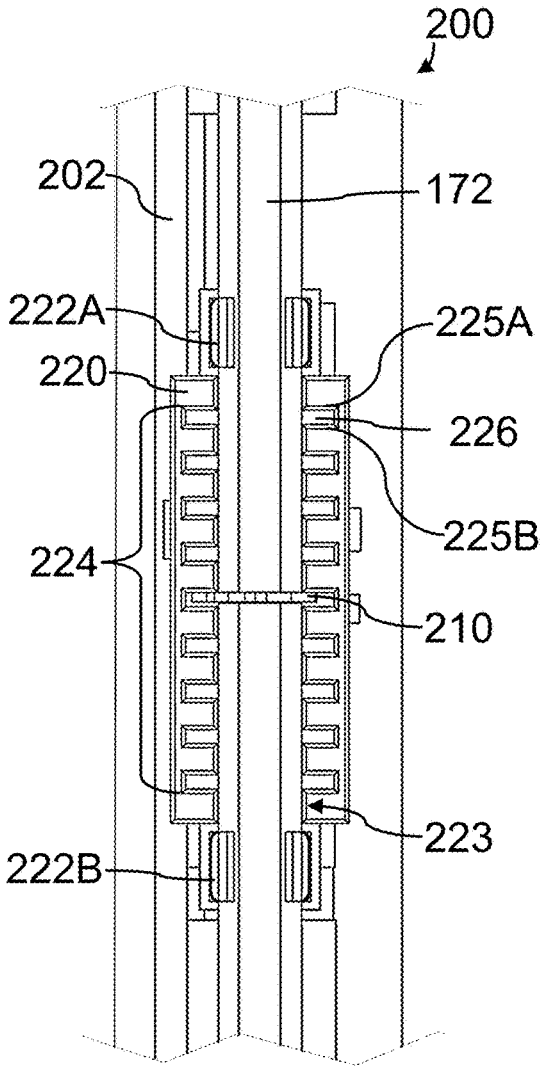
FIG. 11 is an enlarged elevation view of section 11 of FIG. 10.

FIG. 11 is an enlarged elevation view of section 11 of FIG. 10 showing the plurality of grooves 224 and retaining ring 210 in detail. As discussed previously, the second rod 172 is disposed in the rod coupler channel 223 and secured therein by spring clips 222A, 222B. Of course, while multiple spring clips are shown in FIGS. 10-11, any number of suitable retaining elements may be employed, as the present disclosure is not so limited. As best shown in FIG. 11, each of the plurality of grooves includes a first inclined lead-in 225A, and second inclined lead-in 225B, and a retaining groove 226. The inclined lead-ins may be suitable to guide the retaining ring into the nearest groove when the side latch is inserted into a mortise opening. That is, the lead-ins allow the second rod and retaining ring 210 to self-align with the nearest groove based on the camming action of the inclined lead-ins. Once disposed in the retaining groove 226, the retaining ring may transmit force between the rod coupler 220 and the second rod so that the hook latch head (see FIGS. 8-9) may be moved between a hook engaged and a hook disengaged position. According to the embodiment shown in FIGS. 10-11, the rod coupler includes nine grooves which provide a suitable amount of self-adjustability between the side latch and the second rod. However, any suitable number of grooves may be employed to provide any suitable amount of adjustability, including, but not limited to, as few as two grooves and as many as 20 grooves.

Figure 12:
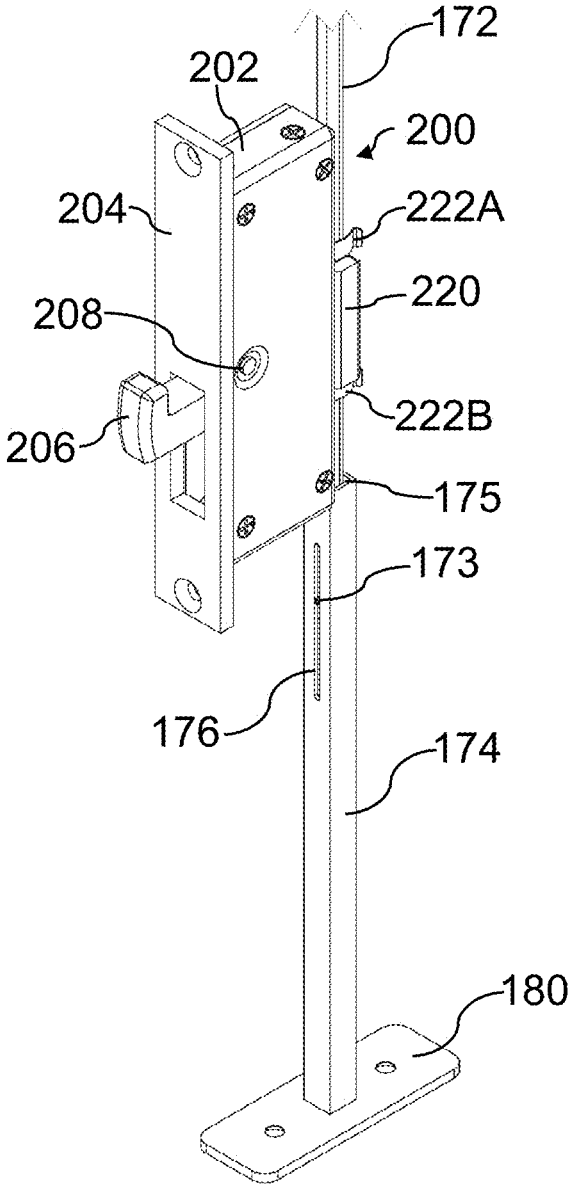
FIG. 12 is a perspective view of the side latch of FIG. 9 and one embodiment of a rod guide.

FIG. 12 is a perspective view of the side latch 200 of FIG. 9 and one embodiment of a rod guide 174. As shown in FIG. 12, the rod guide includes a rod channel 175, and rod guide slot 176, and a base 180. The base is configured to be mounted to the threshold portion of a door to secure the rod guide to the door. The rod channel 175 receives the second rod 172 and may be shaped and sized to limit the range of motions for the second rod. That is, the second rod may be closely fit or have a complementary shape with the rod channel so that the second rod is substantially constrained to linear motion along its longitudinal axis and alignment between the second rod and side latch is maintained. Additionally, the rod guide slot 176 is configured to receive a second rod pin 173 so that the motion of the second rod is further limited to motion along its longitudinal axis. Such an arrangement may promote reliable and consistent actuation of the side latch. Additionally, as shown in FIG. 12, the rod guide may extend from the bottom the door past to a position proximate the chassis 202 of the side latch. That is, the rod guide may be approximately equidistant from the bottom of a door relative to the bottom of the chassis of the side latch. Such an arrangement may provide substantial stability to the second rod without interference with the installation or operation of the side latch. Of course, the rod guide may have any suitable shape or extend any suitable distance from the bottom of the door to effectively guide the second rod, as the present disclosure is not so limited.

Figure 13:
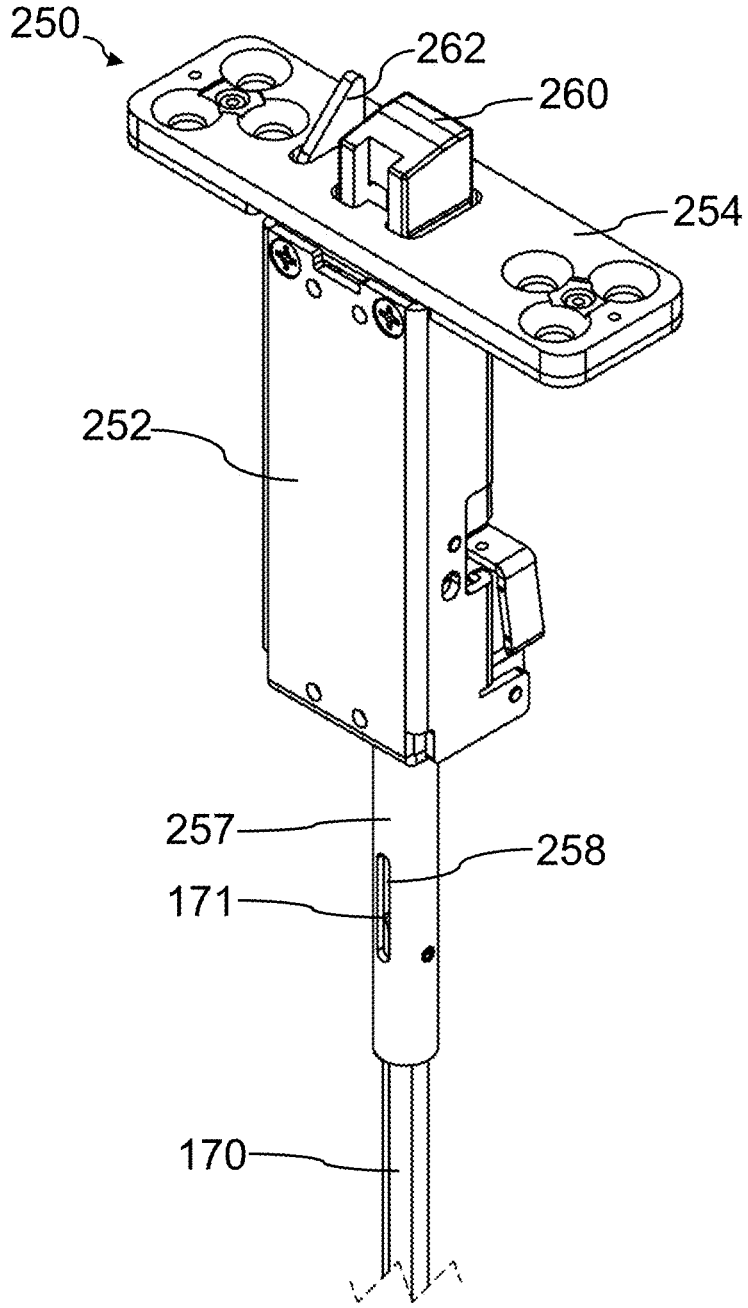
FIG. 13 is a perspective view of one embodiment of a transom latch for the multi-point latching device of FIG. 1.

FIG. 13 is a perspective view of one embodiment of a transom latch 250 for use in the multi-point latching device of FIG. 1. As discussed previously, the transom latch is configured to secure an associated door to a doorway transom. The transom latch includes a chassis 252 which is secured in the top of the door by transom face plate 254. The transom latch includes a latch head 260 and a trigger 262. The trigger 262 has an inclined face and is configured to automatically retract when the trigger strikes a transom strike plate, whereas the latch head 260 is not configured to automatically retract. Accordingly, the trigger may be employed to time the release of the latch head 260 so that the latch head does not interfere with a transom strike plate when opening or closing the door, as will be discussed further with reference to FIG. 14. As shown in FIG. 13, the chassis 252 of the transom latch includes a transom rod guide 257 which is configured to receive the first rod 170. The first rod guide includes a transom rod guide slot 258 configured to receive a first rod pin 171 which constrains the motion of the first rod to linear motion along its longitudinal axis and maintains alignment of the first rod with the transom latch. Accordingly, the first rod 170 may be used to reliably move the latch head 260 between engaged and disengaged positions with linear motion.

Figure 14:
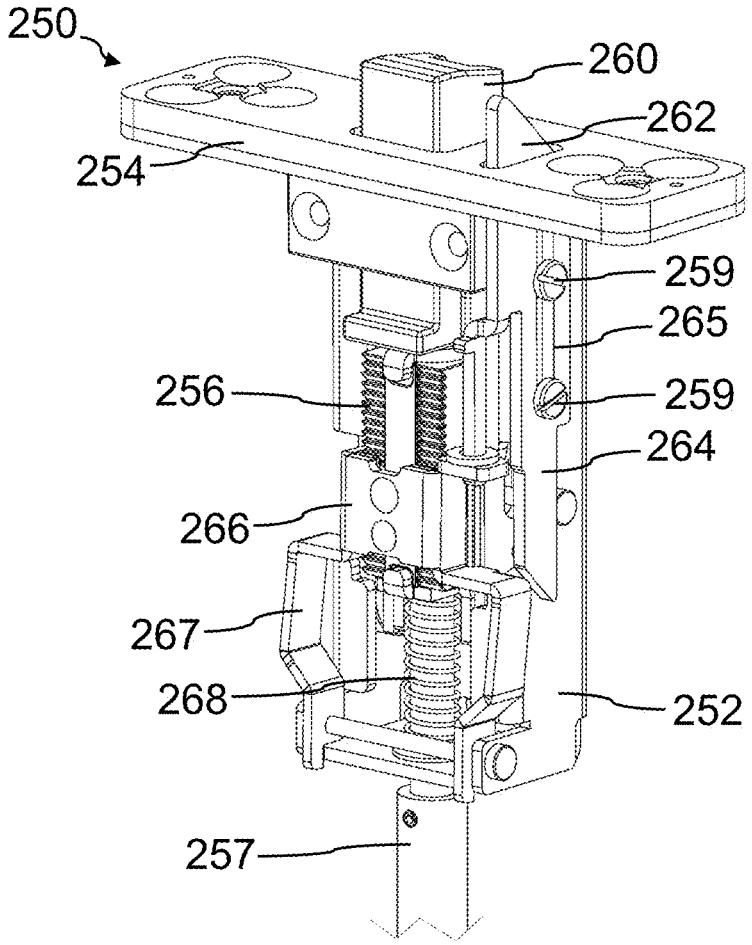
FIG. 14 is another perspective view of the transom latch of FIG. 13.

FIG. 14 is another perspective view of the transom latch 250 of FIG. 14 showing the lockout 266 and trigger 262 in detail. As best shown in FIG. 14, the trigger 262 is configured to slide on trigger supports 259 disposed in trigger slot 265. The trigger includes a lockout engagement portion 264 which is configured as a camming surface which moves the lockout when the trigger is moved from the extended position shown in FIG. 14 to a retracted position. The lockout 266 is disposed on a rotatable lockout arm 267 and is configured to engage a plurality of ratchet teeth 256. The lockout may be spring loaded so that the lockout positively engages the ratchet teeth in a resting position. The ratchet teeth are configured to allow the latch head 260 to move from the engaged position (e.g., extended position) shown in FIG. 14 to a disengaged position (e.g., a retracted position) but does not allow the opposite motion. Accordingly, when the latch head is retracted by activation of an associated actuator and tension applied through a first rod, the lockout progressively engages the ratchet teeth to maintain the latch head in the disengaged position. When the associated actuator is released (e.g., when the door is fully open), the latch head is kept in the disengaged position by the lockout against the urging of a biasing member 268 which urges the latch head toward the engaged position. When the door closes and the trigger is retraced by a transom strike plate, the lockout engagement portion (i.e., a first camming surface) engages the rotatable lockout arm (i.e., a second camming surface) to move the lockout up and away from the ratchet teeth. When the lockout clears the ratchet teeth, the latch head may automatically return to the engaged position under influence from the biasing member 268. The trigger 262 may be configured so that the lockout does not clear the ratchet teeth to release the latch head until the latch head is positioned over a transom latch head receptacle so that interference during extension is minimized or eliminated.

According to the embodiment shown in FIG. 14 and as discussed previously, the biasing member 268 may be used to bias the entirety of the multi-point latching device mechanism toward a secure position (i.e., where all associated latches are in engaged positions). Accordingly, the lockout 266 may also be used to control the motion of the entirely of the multi-point latching device, and, in particular, an associated side latch having a hook latch head (see FIGS. 8-9). That is, when the multi-point latching device is actuated and the latch head is moved to a disengaged position, a hook latch head of the side latch may also be moved to a hook disengaged position. When the lockout engages the ratchet teeth 256, it may hold both the latch head 260 and the hook latch head in the disengaged positions so that there is no interference opening and closing the door. When the trigger causes the lockout to clear the ratchet teeth, the latch head and the hook latch head may be released so that they may be moved to the engaged and hook engaged positions, respectively. The trigger may be configured to release the latch head and hook latch head once each of the latch heads is positioned over a corresponding receptacle so that interference between the latch heads and the doorway is reduced or eliminated.

Figure 15:
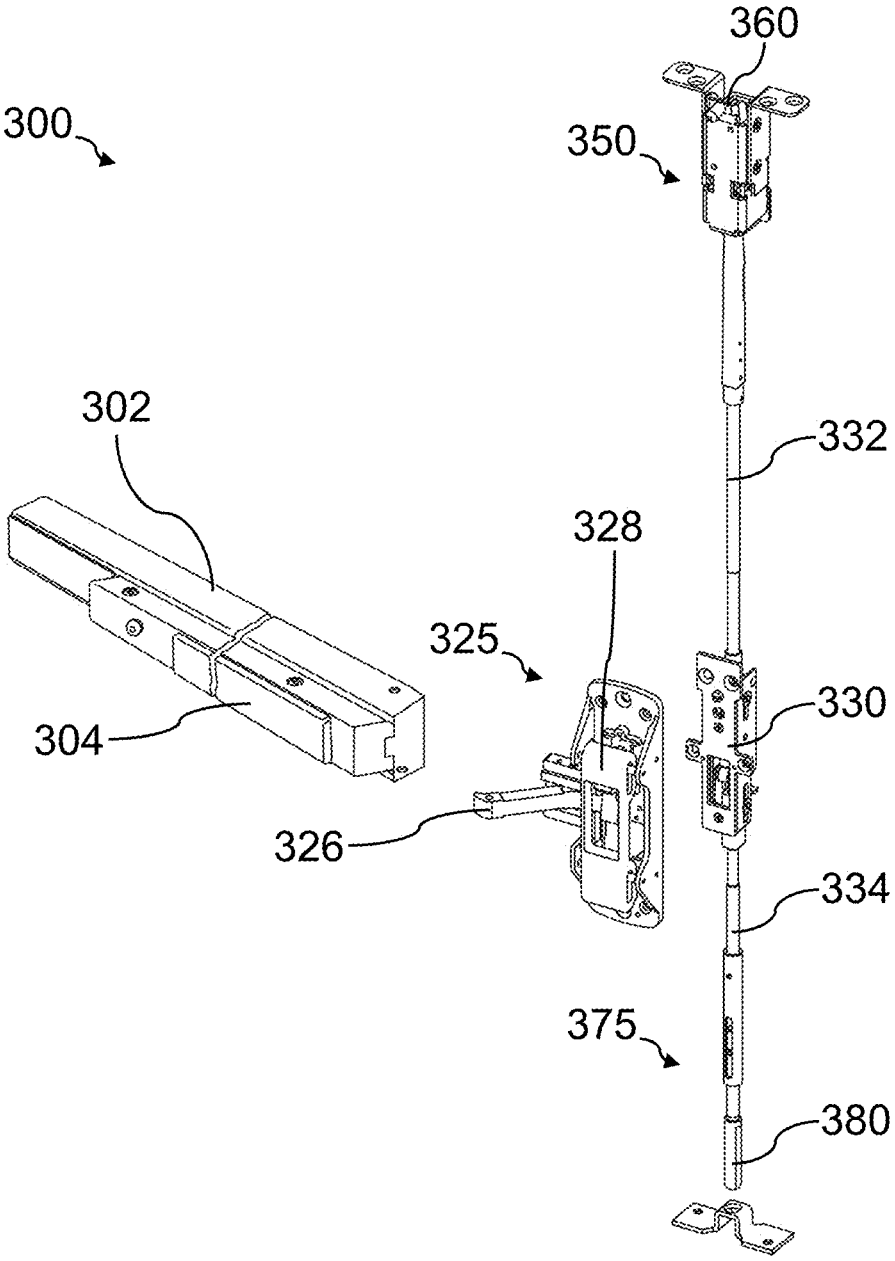
FIG. 15 is an exploded view of another embodiment of a multi-point latching device.

FIG. 15 is an exploded view of another embodiment of a multi-point latching device 300 including a transom latch 350 and a bottom latch 375. According to the embodiment of FIG. 15, the multi-point latching device is configured to be used with an exit device which includes a rail 302 and a push bar 304. The push bar may be used to manipulate a lever 326 of an actuator 325 which in turn moves a slider between vertical positions. The slider and lever 326 in turn interact with a rod actuator 330 to reciprocate a first vertical rod 332 and a second vertical rod 334. The first and second vertical rods in turn move a transom latch head 360 of the transform latch as well as a bottom latch head 380 of the bottom latch between engaged and disengaged positions to correspond to a position of the lever 326. In some embodiments, the multi-point latch of FIG. 15 may employ vertical rod couplers (see FIGS. 16-26) which couple the first and second vertical rods to the rod actuator 330. These vertical rod couplers may allow the relative positions of the first and second vertical rods to be adjusted relative to the rod actuator and/or lever so that the multi-point latching device may be easily configured for any door.

Figure 16:
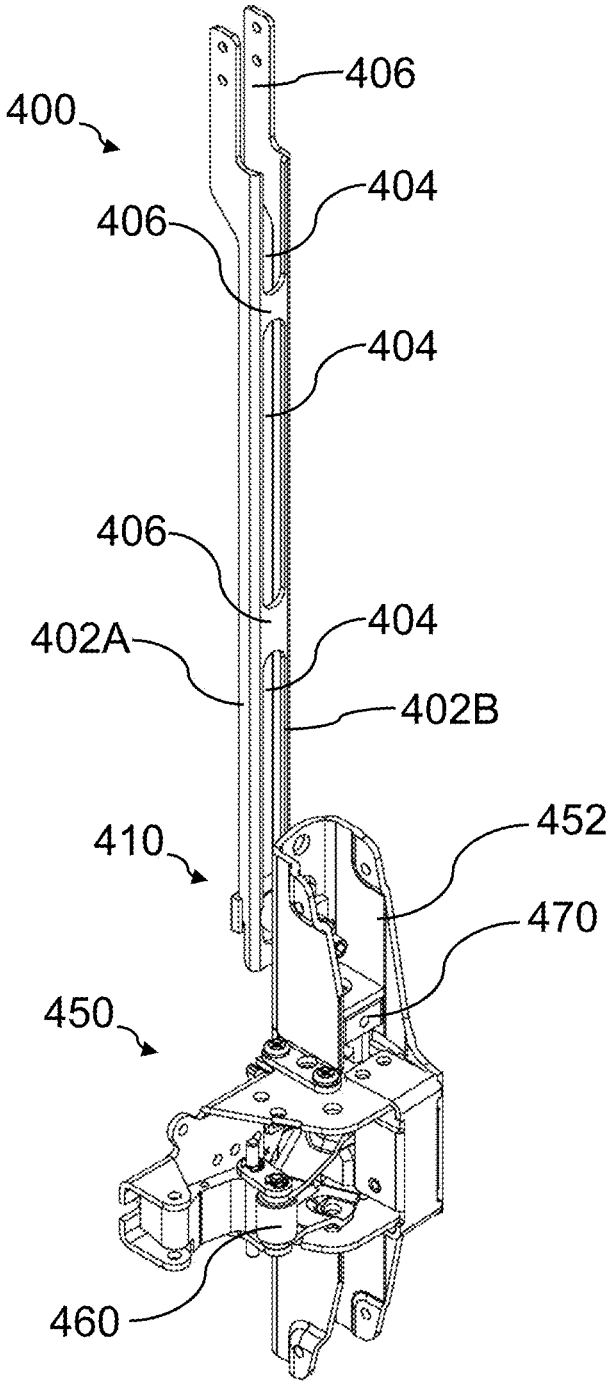
FIG. 16 is a perspective view of a vertical rod, actuator, and vertical rod coupler of the multi-point latching device of FIG. 15.

FIG. 16 is a perspective view of one embodiment of a vertical rod 400, actuator 450, and vertical rod coupler 410. According to the embodiment shown in FIG. 16, the vertical rod coupler 410 may be used to easily and reliably adjust the position of the vertical rod in a door while the door is hung in a door frame. Additionally, the vertical rod coupler may allow the vertical rod to self-adjust based on a force balance of gravity and biasing forces from biasing members in associated latching devices. As shown in FIG. 16, the vertical rod 400 is shaped as a beam and includes a first portion 402A and a second portion 402B which are separated by through channels 404. The first portion and second portion are connected by cross-beams 406. Taken together, the vertical rod is configured to reliably transmit force in a linear direction along a longitudinal direction of the vertical rod. As shown in FIG. 16, the vertical rod includes a latch coupler 406 which may be used to secure an associated latch which converts linear force from the vertical rod into movement of a latch between engaged and disengaged positions. The vertical rod is coupled to the actuator 450 via the vertical rod coupler 410 which is slidably disposed in a chassis 452 of the actuator. Similar to previously described embodiments, the actuator includes a lever 460 and a slider 470 which cooperate to generate linear motion which is transferred to the vertical rod via the vertical rod coupler. As will be described further with reference to FIG. 17, the vertical rod is captures between a bracket and cam lock of the vertical rod coupler which apply an adjustable clamping force to the vertical rod to selectively couple or decouple the vertical rod from the actuator.

Figure 17:
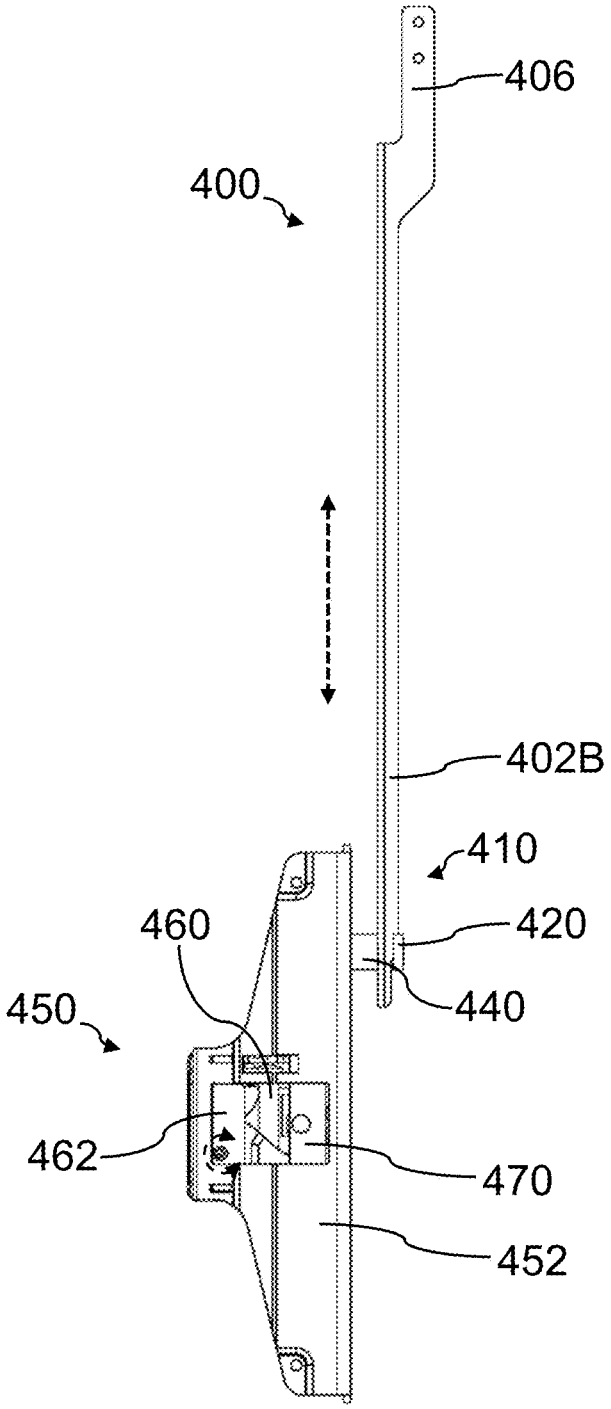
FIG. 17 is a side elevation view of the vertical rod and actuator of FIG. 16.

FIG. 17 is a side elevation view of the vertical rod 400, actuator 450, and vertical rod coupler 410 of FIG. 1 showing the motion of the vertical rod as induced by the actuator via the vertical rod coupler. As noted previously, the actuator includes a lever 460 and a slider 470. As shown in FIG. 17, the lever is configured to engage a rotatable cam 462 which rotates as shown in the dashed arrow to engage the slider 470. That is, the lever cams the rotatable cam 462, which in turn reciprocates the slider 470. The slider 470 is rigidly coupled to the vertical rod coupler 410 so that the vertical rod coupler reciprocates in response to actuation of the lever 460 (e.g., by an exit device). The vertical rod coupler selectively transfers this reciprocal motion to the vertical rod depending on the state of the vertical rod coupler. As shown in FIG. 17, the rod coupler includes a cam lock 440 and a bracket 420 which capture the vertical rod between them and apply a clamping force to the vertical rod. When the clamping force is above a threshold level (i.e., a level where operation of the actuator and associated latching hardware does not exceed the resultant frictional force), the vertical rod is coupled to the actuator through vertical rod coupler and reciprocates as shown by the dashed line. However, when the clamping force is below a threshold level (i.e., a level where operation of the actuator and/or a passive force such as gravity overcomes the resultant frictional force) the vertical rod is decoupled from the actuator. Thus, the adjustable clamping force of the vertical rod coupler may allow a vertical rod to be easily coupled or decoupled to the actuator. As will be discussed further with reference to FIGS. 18-23, the clamping force applied to the vertical rod may be quick and simple for an operator to adjust.

Figure 18:
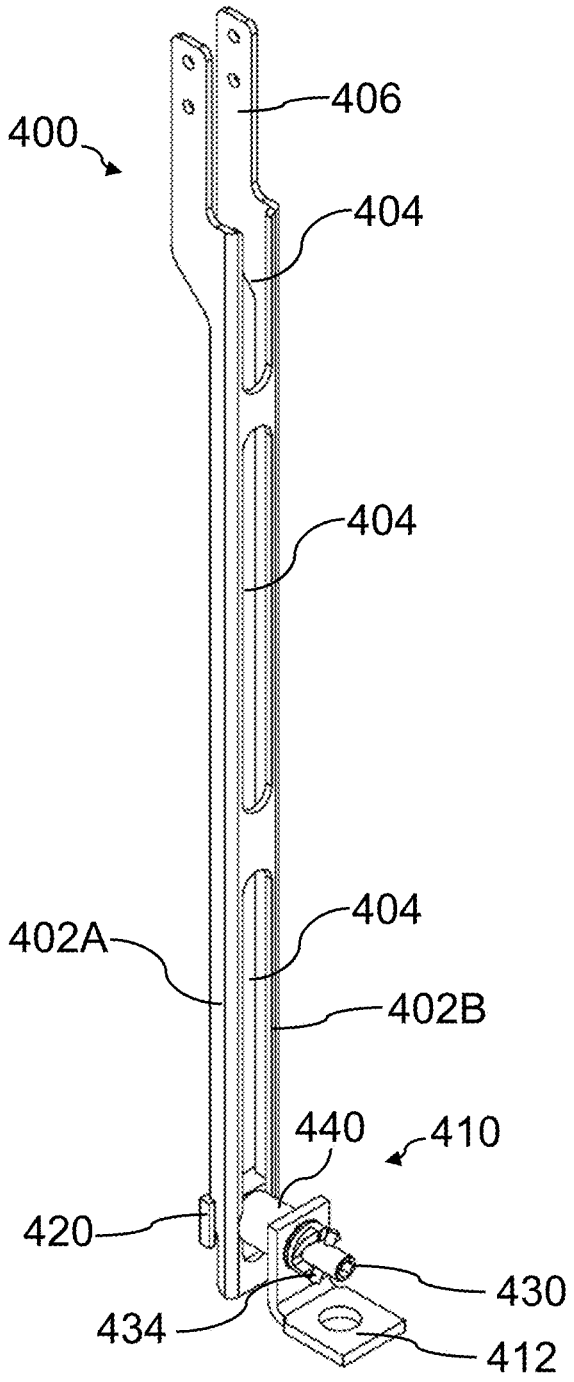
FIG. 18 is a perspective view of the vertical rod and vertical rod coupler of FIG. 15.

FIG. 18 is a perspective view of the vertical rod 400 and vertical rod coupler 410 of FIG. 15 removed from the actuator to more clearly show the functionality of the vertical rod coupler. As noted previously, the vertical rod coupler may be easily adjusted to change the clamping force applied to the vertical rod to couple or decouple the vertical rod from an actuator. Additionally, the vertical rod coupler may allow the vertical rod to slide relative to the actuator to self-adjust based on passive forces from gravity or biasing members of an associated latching device coupled to the vertical rod. According to the embodiment shown in FIG. 18, the vertical rod coupler may be selectively coupled or decoupled to the vertical rod with less than a half-turn of a bolt. As shown in FIG. 18, the vertical rod coupler includes a bracket 420, a cam lock 440, and a bolt 430. The bracket and cam lock are engaged on either side of the vertical rod and are partially disposed in a through channel 404 of the vertical rod. The bolt is disposed through the bracket and the cam lock and includes a transverse pin 434 which is configured to engage the cam lock. A slider bracket 412 is used to couple the cam lock to a slider of an actuator or other suitable component for transmitting reciprocal motion to the vertical rod coupler. According to the embodiment of FIG. 18, the bolt 430 may be rotated so that the transverse pin engages different portions of a camming surface of the cam bolt. The engagement between the transverse pin and the cam bolt may adjust the tension in the bolt which modifies the clamping force applied to the vertical rod.

Figure 19:
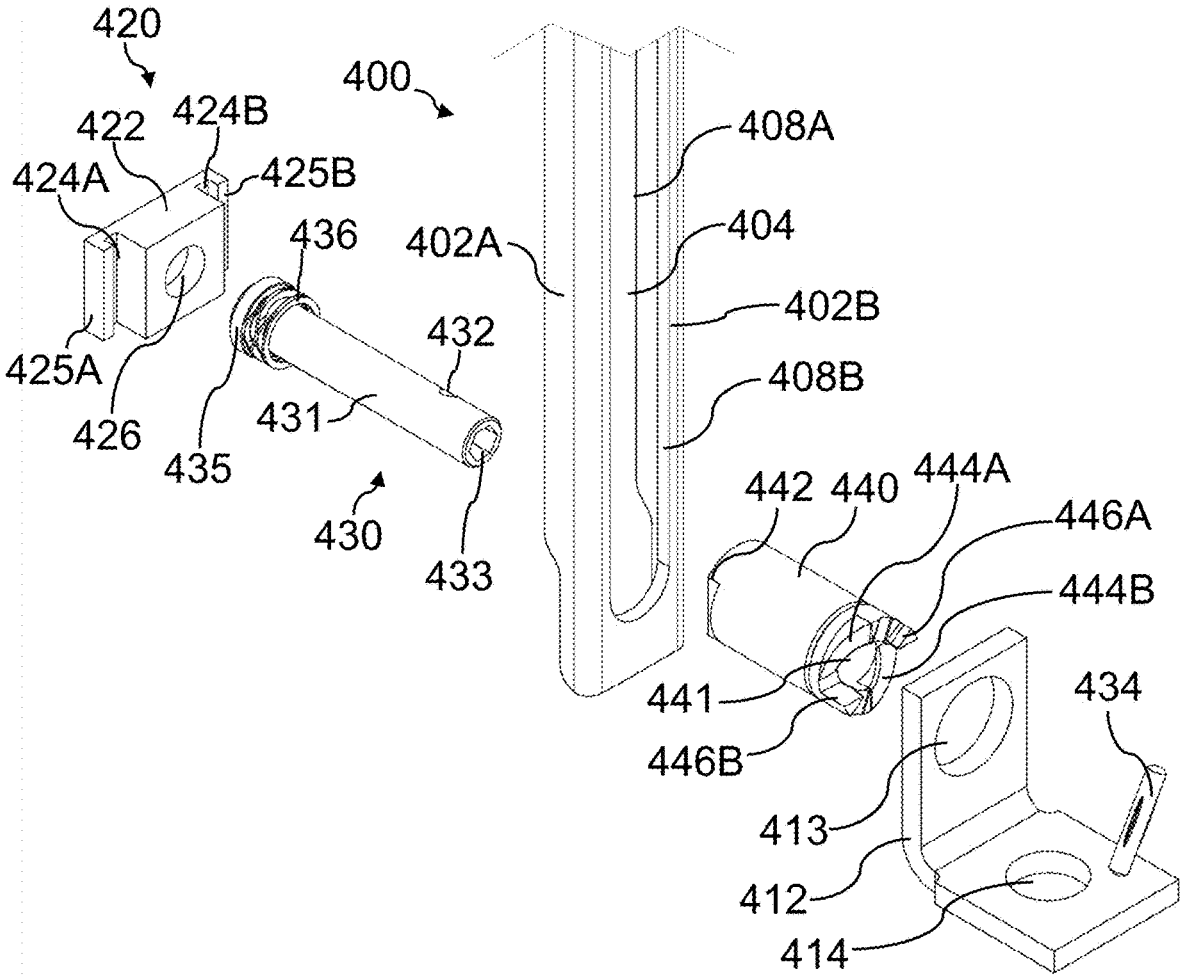
FIG. 19 is an exploded view of the vertical rod and vertical rod coupler of FIG. 18.

FIG. 19 is an exploded view of the vertical rod 400 and vertical rod coupler 410 of FIG. 18 showing how the components of the vertical rod coupler interact to allow the vertical rod to be coupled or decoupled in a simple manner. As noted previously, the vertical rod coupler includes a bracket 420, a cam lock 440, and a bolt 430. The bracket and cam lock are arranged to capture the vertical rod and constrain motion of the vertical rod when the rod is decoupled to linear sliding motion relative to the vertical rod coupler so that the vertical rod may be recoupled easily. Accordingly, the bracket 420 includes a central portion 422, a first wing 425A, and a second wing 425B. The first wing includes a first channel 424A formed therein and the second wing includes a second channel 424B formed therein. The first channel and second channel each receive the first portion 402A and second portion 402B of the vertical rod, respectively. Additionally, the central portion 422 is configured to fit into a first through channel portion 408A of the through channel 404 so that the vertical rod is constrained to slide along the channels. The central portion 422 also includes a bracket through-hole 426 configured to receive the bolt 436. As shown in FIG. 19, the cam lock 440 includes an engagement portion configured to be inserted into a second through channel portion 408B to similarly constrain the vertical rod to linear sliding motion relative to the vertical rod coupler when the vertical rod is decoupled from the vertical rod coupler.

According to the embodiment of FIG. 19, the bolt 430 is configured to retain the bracket 420 and the cam lock 440 around the vertical rod and to generation a tension force which is proportional to the clamping force applied by the bracket and cam lock to the vertical rod. In particular, the bolt may be rotated between rotational positions to quickly adjust a tension force in the bolt to correspondingly modify a clamping force applied to the vertical rod, thereby coupling or decoupling the vertical rod from the vertical rod coupler. As shown in FIG. 19, the bolt includes a shaft 431 having a transverse through-hole 432 configured to receive a transverse pin and a socket 433 disposed on a distal end of the shaft. The bolt also includes a head 435 and a biasing member 436 configured as a stacked disc wave spring. The shaft of the bolt is configured to be disposed in the bracket through-hole 426 and a cam lock through-hole 441. The head 435 is configured to be disposed outside of the bracket and the transverse pin 434 is configured to be disposed outside of the cam lock, so that the bracket and the cam lock are retained on the shaft of the bolt. The biasing member 436 of the bolt is configured to engage the bracket and generate a biasing force based on the distance between the head of the bolt and the bracket. This biasing force is proportional to the tension force in the shaft of the bolt, as will be discussed further in detail with reference to FIGS. 22-23.

According to the embodiment of FIG. 19, the transverse pin 434 is configured to engage the cam lock 440 along pin camming surfaces 444A, 444B which, according to this embodiment, are arranged as ramps. The pin camming surfaces are configured to adjust the relative positioning between the bolt 430, bracket 420, and cam lock 440 so that the clamping force applied to the vertical rod may be adjusted and the vertical rod may be selectively coupled to the vertical rod coupler. That is, the relative positioning of the bolt, bracket, and cam lock may alter a tension force in the bolt which corresponds to a clamping force applied by the bracket and cam lock to selectively secure the vertical rod to the vertical rod coupling. In the embodiment of FIG. 19, as the bolt is rotated and the transverse pin is correspondingly rotated as the pin moves along the pin camming surfaces which adjust the position of the bolt relative to the bracket and the cam lock. That is, as the bolt is moved in one direction the pin is moved toward a thicker portion of the pin camming surface such that the head 435 of the bolt is moved closer to the bracket 420. As the head is moved closer to the bracket, the biasing member 436 is compressed and generates a larger force which increases the tension in the bolt. This increased tension in turn increased the clamping force applied to the vertical rod, as the tension urges the bracket and the cam lock toward one another to increase clamping and resultant frictional force. Conversely, when the bolt is moved in an opposite direction, the transverse pin moves along the pin camming surface to a thinner portion of the pin camming surface such that the head of the bolt is moved further away from the bracket. Correspondingly, the biasing member 436 expands and the tension in the bolt is reduced, thereby reducing the clamping and resultant frictional force applied to the vertical rod.

As shown in FIG. 19, the cam lock includes a first rotational stop 446A and a second rotational stop 446B which are configured to limit rotation of the bolt and the transverse pin to a particular rotational range. In limiting the rotational range, an operator may quickly switch a coupler from engaged to disengage with less than a full turn of the bolt without removing any components. Thus, limiting the rotational range while maintain the ability of the vertical rod coupler to be selectively coupled or decoupled from the vertical rod great simplifies installation and adjustment of a vertical rod. According to the embodiment shown, the transverse pin may be rotated by approximately 100-120 degrees before rotation is stopped by the rotation stops in either direction. At either end of the rotational range, the tension in the bolt may be adjusted so that the vertical rod coupler is either coupled or decoupled from the vertical rod. That is, in a first rotational position of the bolt the vertical rod coupler may be secured to the vertical rod, and in a second rotational position approximately 100-120 degrees from the first rotational position the rod coupler may be unsecured from the vertical rod. Of course, any suitable number of rotational stops may be employed at any suitable angular distance apart, as the present disclosure is not so limited. For example, in some embodiments, the rotational stops may be spaced from one another by an angle greater than or approximately equal to 45 degrees, 60 degrees, 90 degrees, 100 degrees, 115 degrees, 130 degrees, and/or any other appropriate angle. Correspondingly, the rotational stops may be spaced from one another by an angle less than 180 degrees, 150 degrees, 110 degrees, 75 degrees, 50 degrees, and/or any other appropriate angle.

Combinations of the above noted angles are contemplated, including angles between 45 and 115 degrees as well as 90 and 135 degrees.

As shown in FIG. 19, the vertical rod coupler also includes a slider bracket 412 which couples the vertical rod coupler to an actuator (e.g., a slider) and may interact with a housing of the actuator to substantially constrain the vertical rod coupler to linear motion. The slider bracket 412 of FIG. 19 includes a cam lock receptacle 413 and a slider bolt through-hole 414. The cam lock receptacle is configured to receive the cam and transfers linear reciprocal motion from the slide to the cam lock. The slider bolt through-hole is configured to receive a fastener such as a bolt or screw so that the slider bracket may be secured to the actuator.

Figure 20:
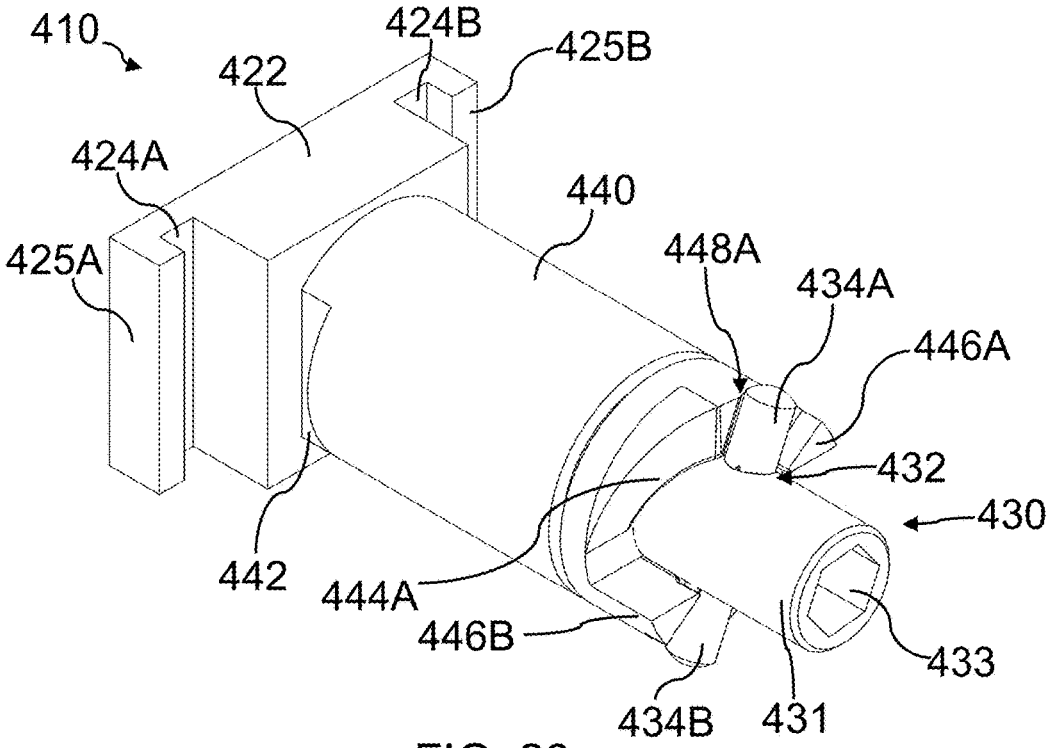
FIG. 20 is a perspective view of one embodiment of a vertical rod coupler.
Figure 21:
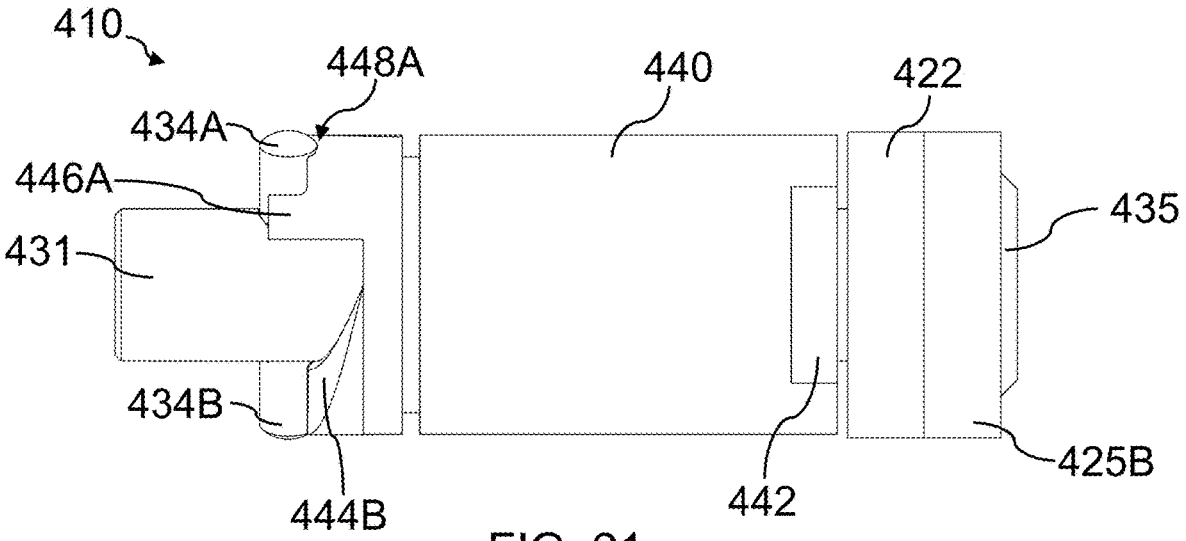
FIG. 21 is a side elevation view of the vertical rod coupler of FIG. 20.

FIGS. 20-21 depict a perspective view and side elevation view, respectively, of the vertical rod coupler 410 of FIG. 19 which clearly show the first pin camming surface 444A configured to engage a transverse pin 434A, 434B to adjust the relative positions of a bracket 420, bolt 430, and cam lock 440. As discussed previously, the vertical rod coupler may be used to selectively couple or secure a vertical rod to an actuator of a multi-point latching device. In particular, in a first state the vertical rod coupler transmits reciprocal motion and force from an actuator to a vertical rod, and a second state the vertical rod coupler allows the vertical rod to slide relative to the vertical rod coupler so reciprocal motion and force is not transmitted between the actuator and the vertical rod. As shown in FIG. 20, the first pin camming surface 444A is arranged as an inclined ramp which a first side 434A of the transverse pin slides along. A second pin camming surface 444B has a corresponding shape which a second side 434B of the transverse pin slides along. The first and second pin camming surfaces are configured to adjust the longitudinal position of the bolt 430 relative to the bracket 420 and cam lock 440 based on the rotational position of the bolt and transverse pin.

In the state shown in FIGS. 20-21, the first side 434A of the transverse pin is disposed in a first depression 438A formed in a thicker portion of the first camming profile. Similarly, the second side of the transverse pin is disposed in a second depression formed in a thicker portion of the second camming profile. In this state, the tension in the bolt may be above a threshold value so that the vertical rod coupler is secured to a vertical rod (i.e., the cam block 440 and bracket 420 apply sufficient clamping force to the vertical rod to inhibit relative movement therebetween). The depressions releasably retain the pin at the thicker portion of the ramp so that a higher tensional force is maintained in the bolt. That is, depressions prevent rotation of the transverse pin and bolt unless a threshold torque is exceeded. According to the embodiment of FIGS. 20-21, the socket 433 in the end of the shaft may be used to apply sufficient torque to exceed the threshold torque to move the transverse pins out of the depressions. The socket of FIGS. 20-21 is arranged as a hex socket configured to receive an Allen key, but any suitable socket or torque transmission interface may be employed, as the present disclosure is not so limited. When the transverse pin is moved out of the depressions it may be moved along the pin camming surfaces to a thinner portion where tension in the bolt is reduced and the clamping force applied to a vertical rod may be reduced to a point where the rod is slidable relative to the vertical rod coupler.

Figure 22:
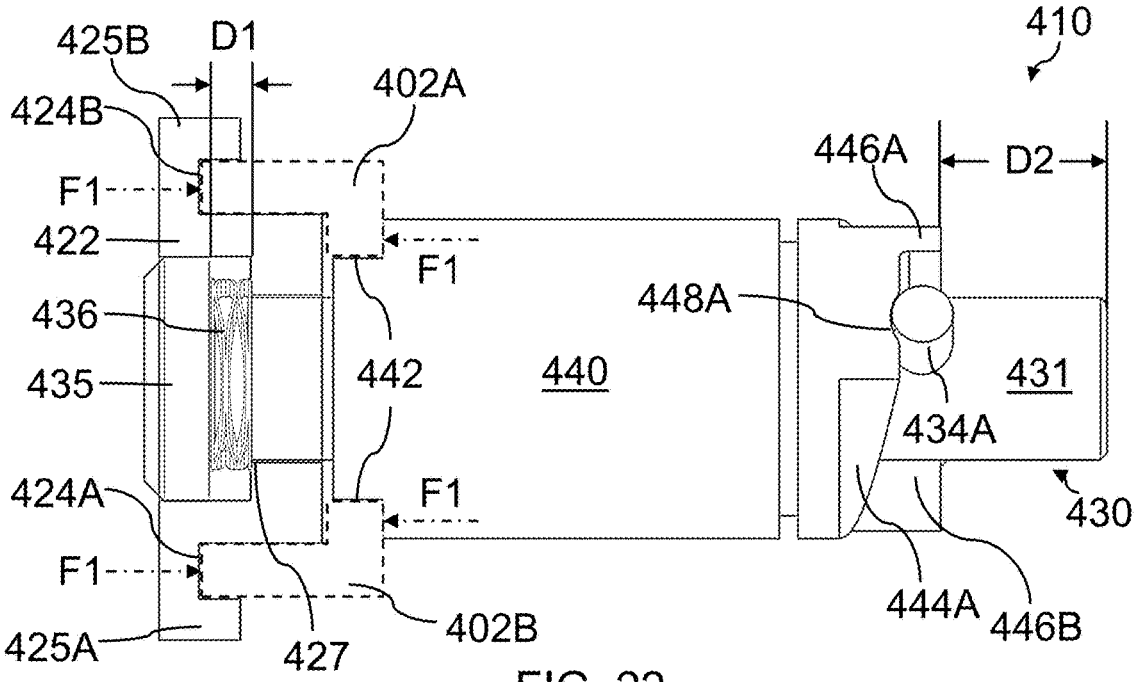
FIG. 22 is a top plan view of the vertical rod coupler of FIG. 20 with a bolt in a first rotational position.

FIG. 22 is a top plan view of the vertical rod coupler 410 of FIG. 20 with the bolt 430 in a first rotational position corresponding to a secured position for a vertical rod (i.e., first portion 402A and second portion 402B shown in dashed). As noted previously, the vertical rod coupler includes a bracket (shown transparently for clarity), a cam lock 440, and a bolt 430. The bolt is disposed through the bracket and cam lock, with the head 435 of the bolt adjacent the central portion 422 of the bracket and the first side 434 of the transverse pin adjacent the cam bolt to secure the bracket and the cam lock along the shaft 431 of the bolt. In the depicted embodiment, the biasing member 436 is configured as a stacked disc wave spring is disposed between the head 435 and the bracket and is configured to apply a biasing force urging the head and the bracket apart. That is, in the state shown in FIG. 22, the biasing member is compressed and urges the head of the bolt away from the central portion of the bracket. This urging force corresponds to a tension force in the bolt which in turn corresponds to a contact force between the transverse pin and the first pin camming surface 444A. Accordingly, the bracket and the cam lock are urged toward one another to apply a first force F1 to the first portion 402A and second portion 402B.

Without wishing to be bound by theory, the force F1 is proportional to a resultant frictional force applied by the bracket and the cam block to the vertical rod portions 402A, 402B. In the state shown in FIG. 22 with the transverse pin disposed in the depressions formed in the thicker portions of the pin camming profile, the force is sufficient to secure the vertical rod to the vertical rod coupler through the force applied from the cam lock and the bracket. Put another way, the clamping force applied by the bracket and cam lock to the vertical rod is above a threshold level suitable to secure the vertical rod to an actuator for operation of a multi-point latching device.

According to the embodiment shown in FIG. 22, the state of the vertical rod coupler 410 corresponds to a position of the bolt 430 relative to the bracket and the cam lock 440. That is, because of the biasing member 436 disposed between the bracket and the cam lock, the clamping force applied to a vertical rod is proportional to the relative position between the bolt and the bracket. As shown in FIG. 22, the head 435 of the bolt is disposed a first distance D1 away from a base 427 of the through-hole. The difference between the first distance D1 and an uncompressed length of the biasing member 436 corresponds to the force produced by the biasing member which in turn at least partly determines the tension in the bolt. The state shown in FIG. 22 also corresponds to a distal most end of the bolt being disposed a second distance D2 from a distal most end of the cam block.

Figure 23:
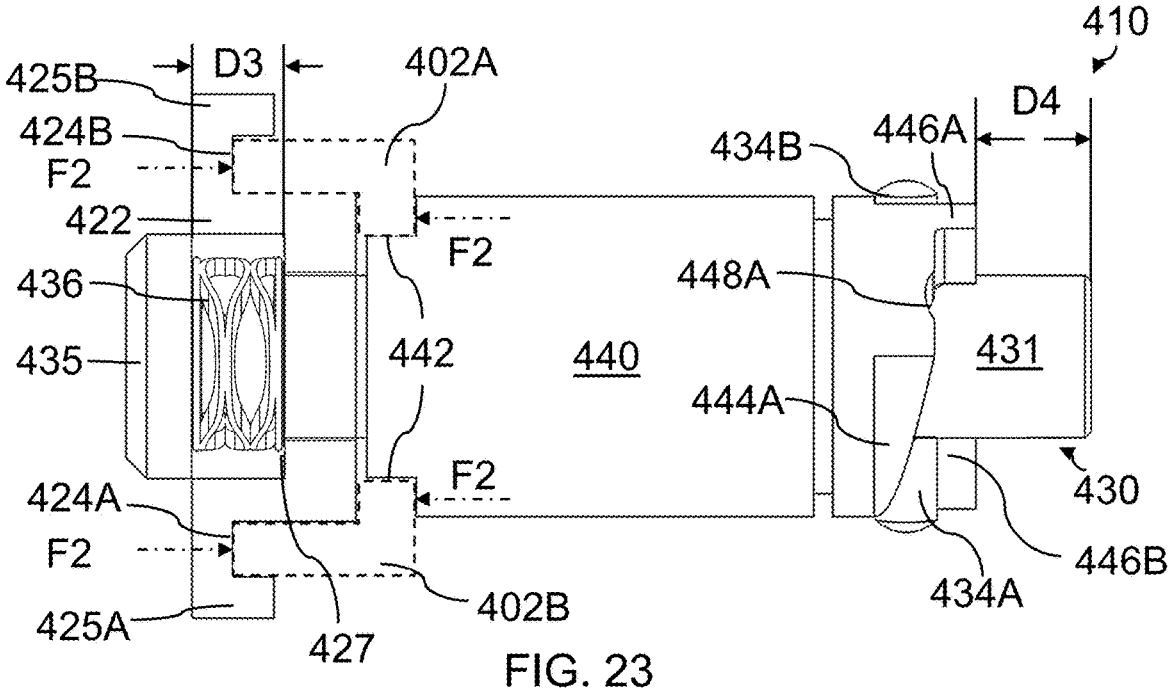
FIG. 23 is a top plan view of the vertical rod coupler of FIG. 20 with a bolt in a second rotational position.

FIG. 23 is a top plan view of the vertical rod coupler 410 of FIG. 20 with the bolt 430 in a second rotational position corresponding to a vertical rod (i.e., first portion 402A and second portion 402B) being slidable relative to the vertical rod coupler. As shown in FIG. 23 and compared with FIG. 22, the bolt 430 has been rotated to a second rotational position so that the transverse pin has been rotated to thinner portions of the pin camming surfaces (e.g., first pin camming surface 444A). That is, both the first side 434A and second side 434B have been moved out of their respective depressions (e.g., first depression 448A) and moved concurrently along the pin camming surfaces. As the bolt is rotated, the basing member 436 urges the bolt head 435 away from the base 427 of the bracket through-hole so that the pin stays in contact with the ramp. The bolt may be rotated between approximately 90 and 135 degrees either toollessly or with a suitable tool such as an Allen key. The bolt may be rotated until the transverse pin comes into contact with first and second rotational stops 446A, 446B which prevent overturning and limit the rotational motion for quick and reliable coupling and decoupling of the vertical rod.

As shown in FIG. 23, in the second rotational position the linear position of the bolt has been adjusted relative to the bracket and the cam lock. That is, the first distance D1 between the bolt head 435 and the base 427 of the bracket through-hole has been increased to distance D3. Correspondingly, the second distance D2 between the distal most end of the bolt 430 and the distal most end of the cam lock 440 has been reduced to a fourth distance D4. As a result, the biasing member 436 has expanded and the force urging the head of the bolt and the bracket apart has been reduced. Accordingly, a tension force in the bolt is suitably reduced to bring a clamping force applied to the first portion 402A and second portion 402B below a threshold force. That is, a force F2 applied to the vertical rod is less than a force F1 applied in the state shown in FIG. 22. Thus, in the state shown in FIG. 23, the vertical rod may be unsecured or uncoupled from the vertical rod coupled and allowed to slide relative to the vertical rod coupler within the channels formed in the bracket.

Figure 24:
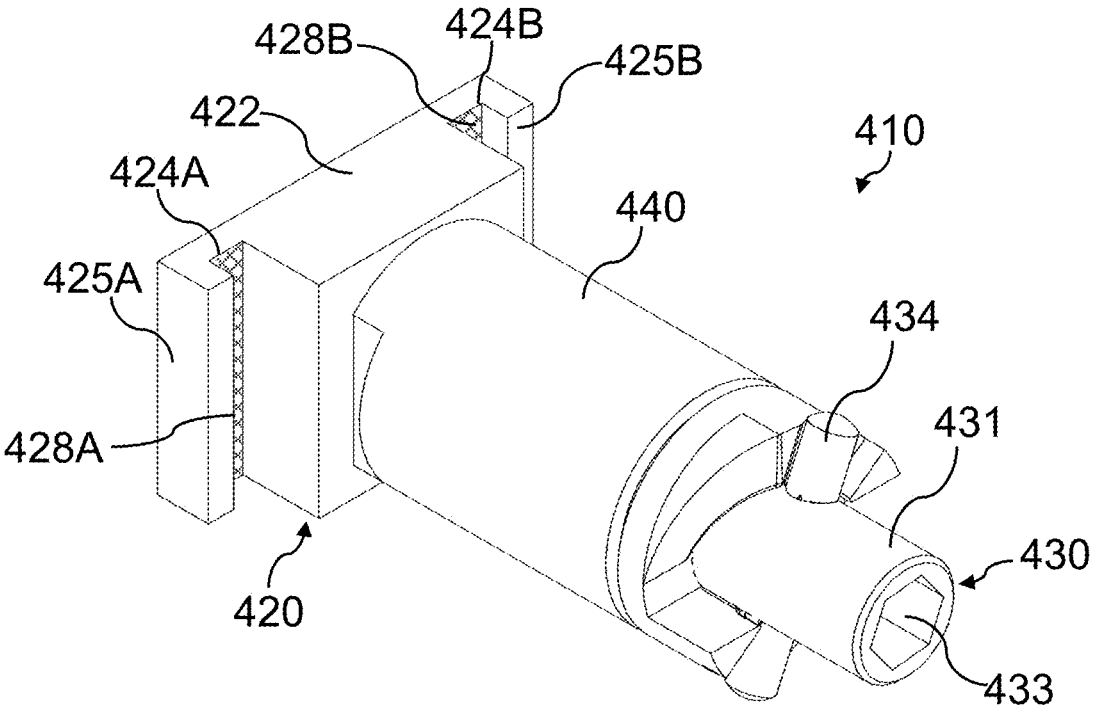
FIG. 24 is a perspective view of another embodiment of a vertical rod coupler.

FIG. 24 is a perspective view of another embodiment of a vertical rod coupler 410 including an added frictional material to increase the coefficient of friction between the vertical rod coupler and a vertical rod. The vertical rod coupler of FIG. 24 is similar to that shown in FIGS. 19-23, including a bracket 420, a bolt 430, and a cam lock 440. In a first rotational position of the bolt, the cam lock and bracket apply a clamping force above a threshold level to secure a vertical rod to the vertical rod coupler and allow reciprocal force transmission between an actuator and the vertical rod. In a second rotational position of the bolt, the cam lock and bracket apply a clamping force below a threshold level to unsecure a vertical rod to the vertical rod coupler to allow the vertical rod to slide relative to the vertical rod coupler. In contrast to prior embodiments, the vertical rod coupler of FIG. 24 includes a first contact surface 428A and a second contract surface 428B which are formed of a high friction material. The high friction material may have a coefficient of friction with the vertical rod of greater than one. For example, the high friction material may be a rubber or similar material. Such an arrangement may improve the security (i.e., vertical force transmission) of the vertical rod when the vertical rod coupler is clamped to the vertical rod. Of course, any suitable material may be employed as the present disclosure is not so limited.

Figure 25:
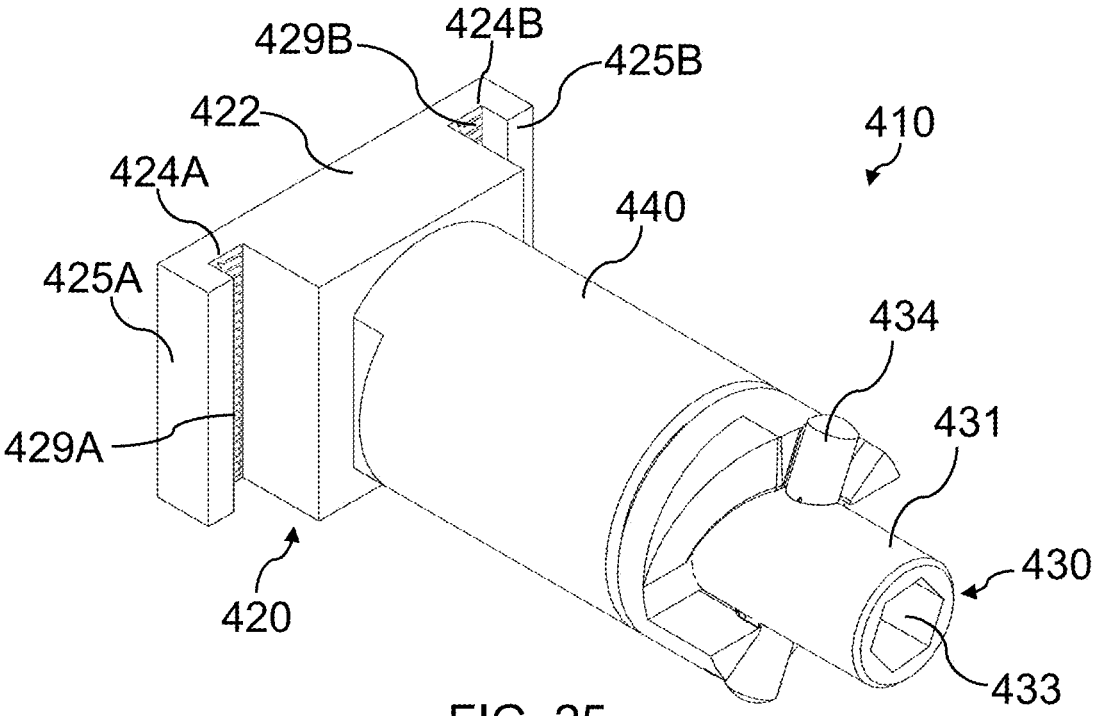
FIG. 25 is a perspective view of yet another embodiment of a vertical rod coupler.

FIG. 25 is a perspective view of yet another embodiment of a vertical rod coupler 410 similar to that of FIG. 24. As shown in FIG. 25, the vertical rod coupler includes a bracket 420, cam lock 440, and bolt 430. The bracket 420 includes a first ratchet 429A and a second ratchet 429B which my engage corresponding ratchets formed on the vertical rod. That is, the vertical rod may include teeth formed which correspond to the teeth of the bracket of FIG. 25. The teeth may increase the force transmission between the vertical rod coupler a vertical rod by allowing interference force to be transmitted in addition to the frictional force. When the vertical rod coupler is unsecured from the vertical rod, the teeth may be configured to clear the teeth formed on the vertical rod so that the vertical rod may slide when the vertical rod coupler is loosened. In some embodiments, the ratchet teeth may be combined with a high friction material (see FIG. 24) to further increase the maximum force transmission between the vertical rod coupler and vertical rod, as the present disclosure is not so limited.

Figure 26:
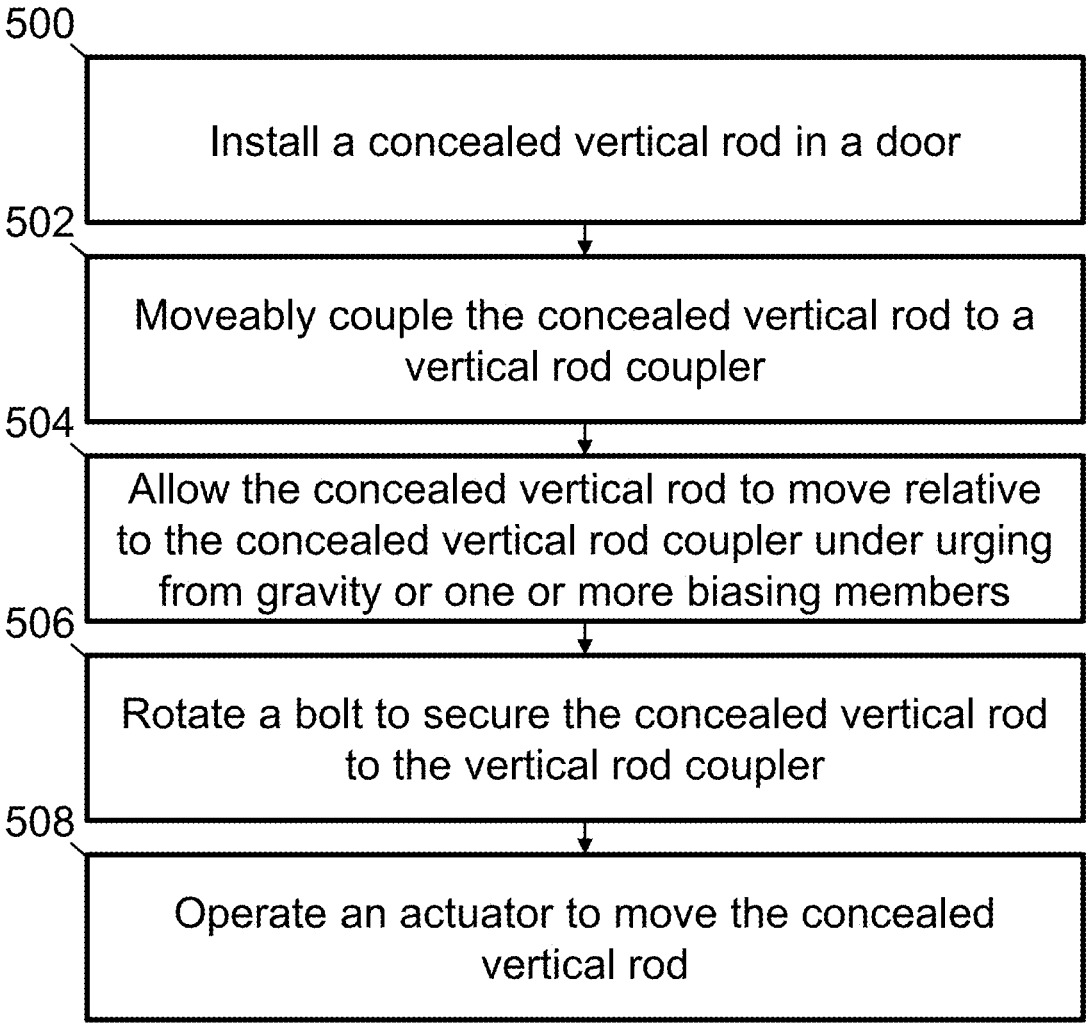
FIG. 26 is a block diagram for one embodiment of a method of adjusting a vertical rod multi-point latching device.

FIG. 26 is a block diagram for one embodiment of a method of adjusting a vertical rod multi-point latching device. In block 500, a concealed vertical rod is installed in a door. For example, a multi-point latching device having a concealed vertical rod for each of a transom latch and a bottom latch or a side latch may be installed in a door. In block 502, the concealed vertical rod is movably coupled to a vertical rod coupler. Movably coupling the vertical rod couple may include capturing the vertical rod between a bracket and a cam block, and rotating a bolt to a first rotational position to allow the vertical rod to slide relative to the vertical rod coupler. In block 504, the concealed vertical rod is allowed to slide under urging from gravity or one or more biasing members of the multi-point latching device. For example, vertical rods will be urged downward relative to Earth by gravity in a hung door. Biasing members which may urge latches associated with the vertical rods may urge the vertical rods in the same direction or opposite that of gravity. In either case, the vertical rods may slide relative to the vertical rod coupler and settle at a resting position. In block 506, a bolt of the vertical rod coupler may be rotated to a second rotational position to secure the concealed vertical rod to the vertical rod coupler. That is, a clamping force applied by the vertical rod coupler may be above a threshold level so that relative sliding movement is inhibited. In block 608, an actuator of the multi-point latching device may be operated to move the concealed vertical rod. With the vertical rod couplers secured, the actuator may reciprocate the vertical rods to extend (i.e., engage) or retract (i.e., disengage) latches of the multi-point latching device. Accordingly, this method allows a multi-point latching device to be self-adjusted with the door hung without any direct manipulation of concealed verticals rods by the operator.

Figure 27:
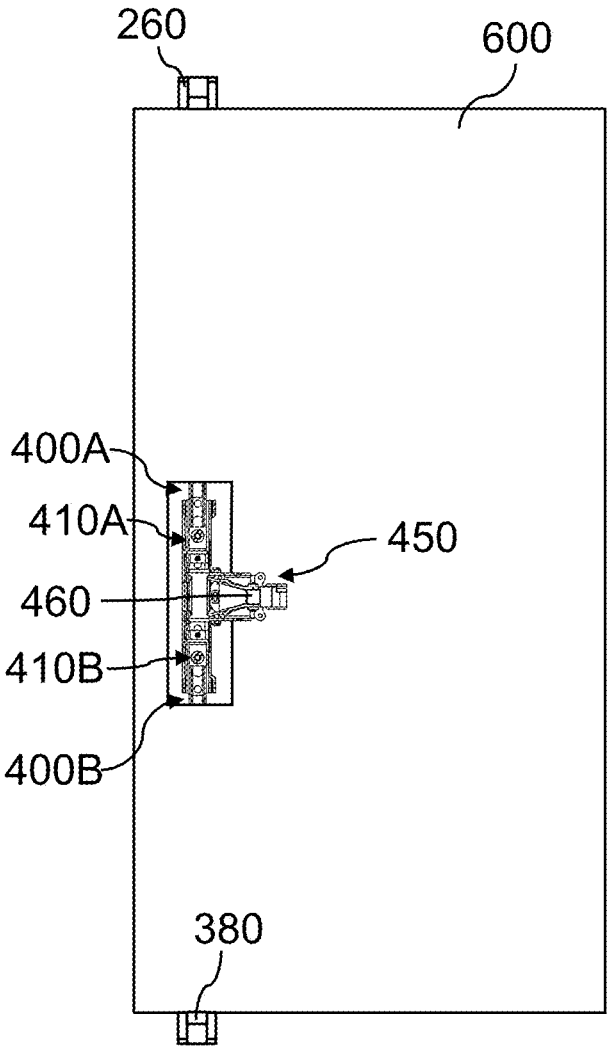
FIG. 27 is a front elevation view of one embodiment of a door including a multi-point latching device according to exemplary embodiments described herein.
Figure 29:
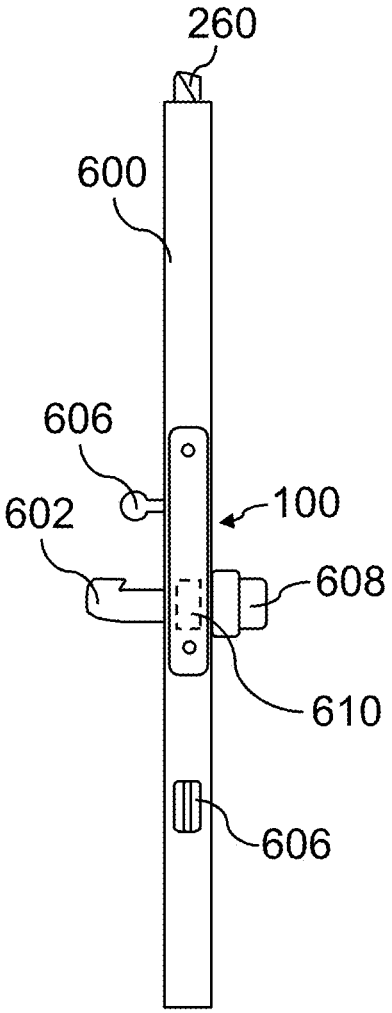
FIG. 29 is a side elevation view of the door of FIG. 29.

FIG. 27 is a front elevation view of one embodiment of a door 600 including and multi-point latching device according to exemplary embodiments described herein. As shown in FIG. 27, a push bar has been removed to show an actuator 450, a first concealed rod 400A, and a second concealed rod 400B disposed in the door. As discussed previously, the actuator may be operated with a lever 460 which may rotated when a push bar is pressed. The first concealed vertical rod and the second concealed vertical rod are coupled to the actuator with a first vertical rod coupler 410A and a second vertical rod coupler 410B, respectively. As shown in FIG. 29, the first concealed vertical rod is coupled to a transom latch 260 configured to extend into a transom of a door frame and the second concealed vertical rod is coupled to a bottom latch 380. The first and second vertical rod coupled are accessible from the front of the door when the door is hung, and accordingly may be switch to selectively allow the first and second concealed vertical rods to slide (e.g., by moving a bolt between first and second rotational positions). When the first and second concealed vertical rods are able to slide, they may settle to an aligned position with the actuator under force of gravity or by biasing members which urge the latches to engaged positions. Accordingly, the position of the concealed vertical rods relative to the actuator may be changed from a single location while the door is hung. Additionally, the adjustment may be automatic once the vertical rod couplers are loosened. Thus, alignment and routine adjustment of concealed vertical rods doors is made simpler through the employ of the concealed vertical rod couplers.

Figure 28:
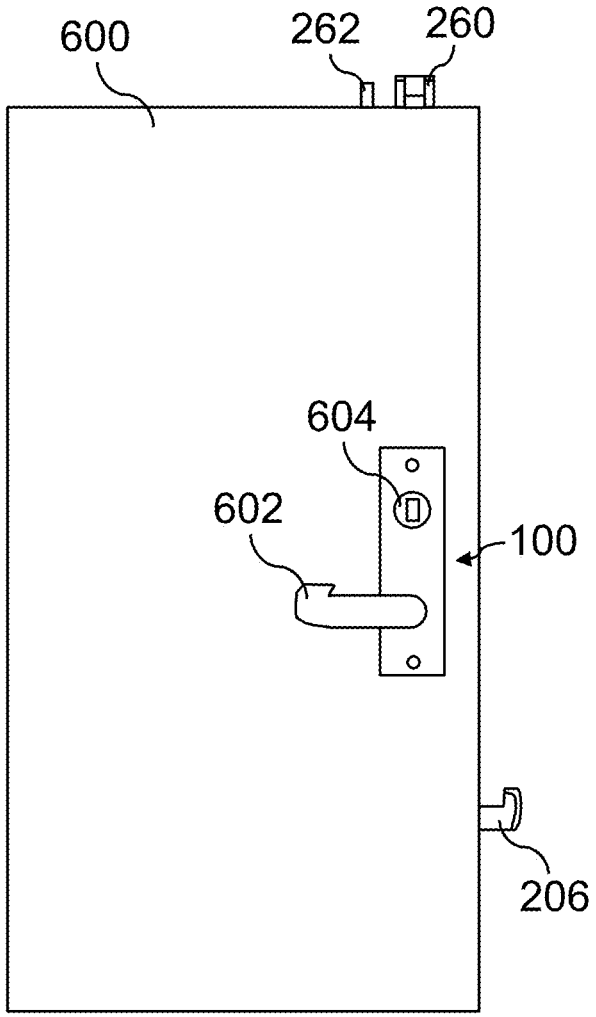
FIG. 28 is a front elevation view of another embodiment of a door including a multi-point latching device according to exemplary embodiments described herein.

FIG. 28 is a front elevation view of one embodiment of a door 600 including and multi-point latching device 100 according to exemplary embodiments described herein. As shown in FIG. 28, the door includes a multi-point latching device 100 having a transom latch head 260, a trigger 262, and a hook latch head 206 which projects from a side of the door. According to the state shown in FIG. 28, the multi-point latching device is in the secured position with the transom latch head 260 in an engaged position and the hook latch head 206 in a hook engaged position which would secure the door to an associated door frame transom and door jamb, respectively. As discussed previously, the trigger 262 may be configured to allow the transom latch head and the hook latch head to extend automatically when the door is closes without significant interference with the door frame. As shown in FIG. 28, the door also includes a handle 602 and a keyhole 604. The handle may be coupled to a handle attachment of an actuator of the multi-point latching device, so that the handle may be turned to move the transom latch head and hook latch head toward a disengaged position and hook disengaged position, respectively. The keyhole may be operated with the use of a corresponding key which may be used to selectively allow use of the handle (i.e., lock or unlock the handle of the door). Of course, any suitable locking device and user interface for interacting with the multi-point latching device may be employed in a door, as the present disclosure is not so limited.

FIG. 29 is a side elevation view of the door 600 of FIG. 28. As shown in FIG. 29, the side of the door opposite that of the handle 602 includes a push bar 608 which may be used to actuate a lever of the multi-point latching device 100. That is, a user may push on the push bar 608 to rotate the lever to move the hook latch head 206 and transom latch head 260 toward a disengaged position and hook disengaged position, respectively, to release the door. In some embodiments, the push bar may be positioned on an interior side of the door which swings outward for efficient egress of an interior space. Of course, while a push bar is shown in FIG. 29, any suitable user interface device which allows a user to actuate the multi-point latching device may be employed, as the present disclosure is not so limited. According to the embodiment shown in FIG. 29 and discussed previously, a key 606 may be used to selectively allow actuation of the multi-point latching device with the handle 602. Such an arrangement may be beneficial to lock an exterior side of the door on which the handle may be disposed. In some embodiments, the multi-point latching device may include an optional third latch head 610 disposed near the handle 602 and push bar 608 which is moved between an engaged position and disengaged position in conjunction with the transom latch head 260 and hook latch head 206. Of course, any suitable number of latch heads or bolts may be employed in the multi-point latching device to secure the door to an associated door frame, as the present disclosure is not so limited.

Figure 30:
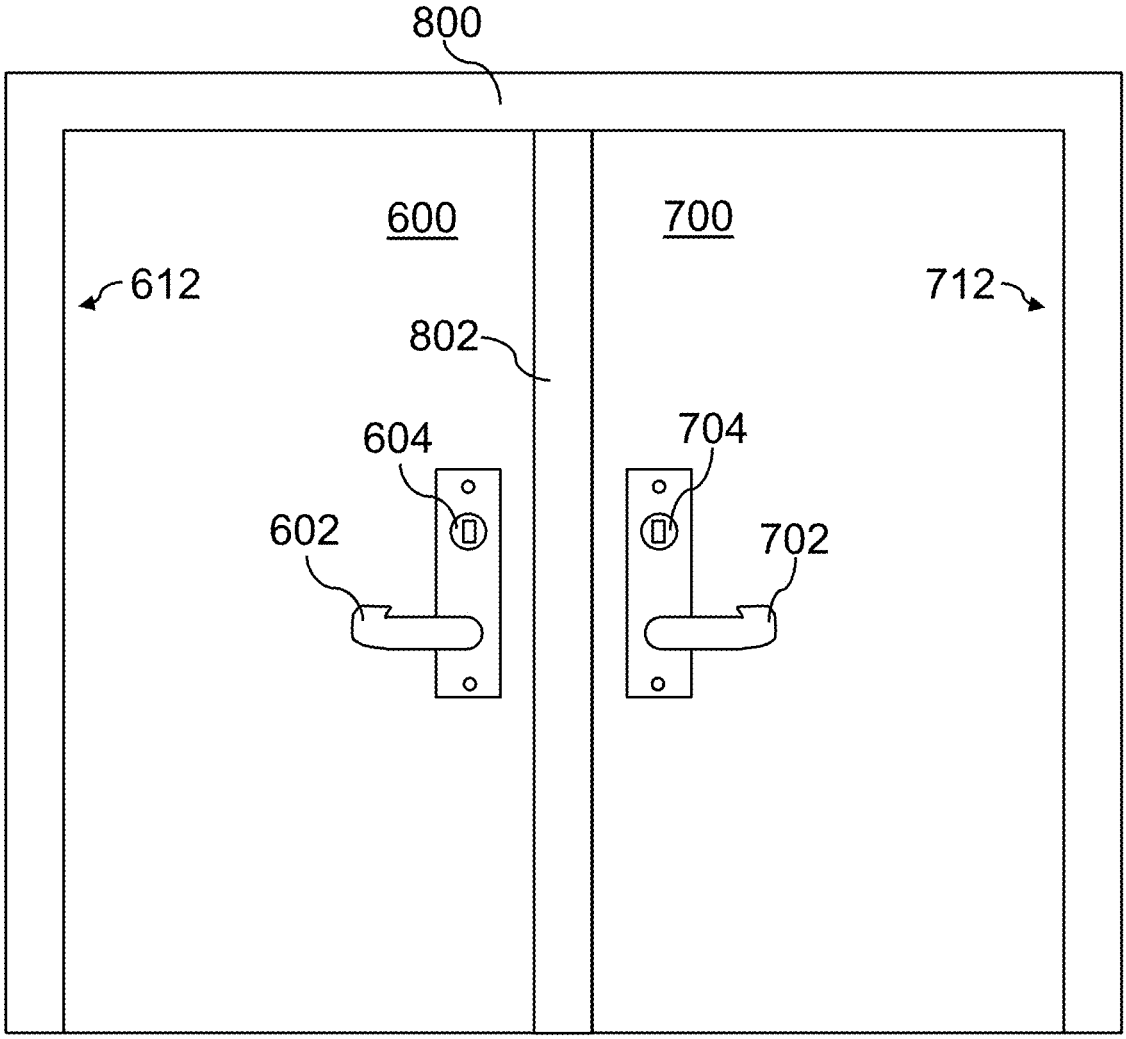
FIG. 30 is a front elevation view of another embodiment of a door and a door frame.

FIG. 30 depicts one embodiment of a door including a first door panel 600, a second door panel 700, and a door frame 800 having a mullion 802. The first door panel is mounted to the door frame at a first hinge interface 612 and the second door panel is mounted to the door frame at a second hinge interface 712. As shown in FIG. 30, a first handle 602 is mounted to the first door panel and is configured to operate a multi-point latching device attached to the door. The multi-point latching device may include a transom latch and a side latch, similar to the embodiment shown in FIGS. 28-29. Additionally a keyhole 604 may be used to selectively secure the first handle 602. According to the embodiment of FIG. 31, the multi-point latching device attached to the first door panel includes a side latch which engages the mullion 802. The mullion may be secured to the door frame transom and an underlying floor so that the secured door may withstand impacts or other forces. According to the embodiment shown in FIG. 30, the second door panel also accommodates an attached multi-point latching device which is operable with a second handle 702. Additionally, a second keyhole may be used in conjunction with a key to selectively secure the second handle. The multi-point latching device attached to the second door panel may be similar to that attached to the first door panel. In some embodiments, a multi-point latching device attached to the second door panel may not include a central actuator, and may instead include a transom bolt, mullion bolt, or bottom bolt which may be manually moved to secure the door. Of course, the second door panel may have any suitable multi-point latching device, latch head, bolt, or lock so that the door may be selectively secure to the door frame, mullion, or underlying floor, as the present disclosure is not so limited.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A vertical rod coupler in combination with a vertical rod, the combination comprising:

a bracket including a bracket through-hole;

a bolt disposed in the bracket through-hole and including a head and a shaft, wherein the shaft includes a transverse pin; and a cam lock including a cam lock through-hole and at least one pin camming surface, wherein the cam lock through-hole is configured to receive the shaft, wherein the at least one pin camming surface is configured to cam the transverse pin to adjust a tension force in the shaft when the shaft is rotated;

wherein the bracket and the cam lock are configured to apply a clamping force to the vertical rod, wherein the clamping force is based at least partly on the tension force, and wherein the bracket includes at least one channel configured to receive the vertical rod and allows a sliding motion of the vertical rod relative to the bracket.

2. The vertical rod coupler in combination with the vertical rod of claim 1, wherein a portion of the bracket, which contacts the vertical rod, includes a material with a dry static coefficient of friction greater than 1.

3. The vertical rod coupler in combination with the vertical rod of claim 1, wherein the at least one channel includes a first bracket channel and a second bracket channel, wherein the bracket includes a central portion positioned between the first bracket channel and the second bracket channel, and wherein the first bracket channel and the second bracket channel are configured to receive a first portion of the vertical rod and a second portion of the vertical rod, respectively.

4. The vertical rod coupler in combination with the vertical rod of claim 3, wherein the bracket through-hole is formed in the central portion.

5. The vertical rod coupler in combination with the vertical rod of claim 1, wherein the cam lock includes at least one depression configured to releasably capture the transverse pin to inhibit rotational movement of the shaft unless a threshold torque is applied to the shaft and/or the transverse pin.

6. The vertical rod coupler in combination with the vertical rod of claim 1, wherein an end of the shaft includes a socket configured to receive torque from an adjustment tool.

7. The vertical rod coupler in combination with the vertical rod of claim 1, wherein the bolt is moveable between a first rotational position and a second rotational position, wherein in the first rotational position the vertical rod is slidable relative to the bracket, and wherein in the second rotational position the vertical rod is stationary relative to the bracket.

8. The vertical rod coupler in combination with the vertical rod of claim 7, wherein in the first rotational position, the clamping force applied to the vertical rod is below a threshold force, and wherein in the second rotational position, the clamping force applied to the vertical rod is at or above the threshold force.

9. The vertical rod coupler in combination with the vertical rod of claim 1, further comprising a compression spring configured to apply an urging force to the bracket and the head, wherein the tension force is proportional to the urging force.

10. The vertical rod coupler in combination with the vertical rod of claim 9, wherein the compression spring is a stacked wave disc spring.

11. The vertical rod coupler in combination with the vertical rod of claim 1, wherein the vertical rod includes a first portion and a second portion separated by a through channel which extends along a longitudinal axis of the vertical rod.

12. The vertical rod coupler in combination with the vertical rod of claim 11, wherein the bracket includes a central portion positioned between a first bracket channel and a second bracket channel, wherein the first bracket channel and the second bracket channel are configured to receive the first portion and the second portion of the vertical rod, respectively.

13. The vertical rod coupler in combination with the vertical rod of claim 12, wherein the central portion is disposed in the through channel, and wherein the bracket through-hole is formed in the central portion.

14. A vertical rod latching device for a door, the vertical rod latching device comprising:

a latch moveable between an engaged and a disengaged position;

an actuator moveable between an actuated position and an unactuated position, wherein in the actuated position, the actuator moves the latch to the disengaged position, and wherein in the unactuated position, the actuator moves the latch to the engaged position;

a vertical rod configured to transmit reciprocal force; and a vertical rod coupler configured to selectively couple the actuator to the vertical rod, wherein the vertical rod coupler comprises:

a bolt moveable between a first rotational position and a second rotational position, wherein when the bolt is in in the first rotational position, the vertical rod is decoupled from the actuator, and wherein when the bolt is in the second rotational position, the vertical rod is coupled to the actuator, a bracket including a bracket through-hole, wherein the bolt is disposed in the bracket through-hole, and wherein the bolt includes a head and a shaft, wherein the shaft includes a transverse pin, and a cam lock including a cam lock through-hole and at least one pin camming surface, wherein the cam lock through-hole is configured to receive the shaft, wherein the at least one pin camming surface is configured to cam the transverse pin to adjust a tension force in the shaft when the bolt is rotated between the first rotational position and the second rotational position, wherein the bracket and the cam lock are configured to apply a clamping force to the vertical rod, wherein the clamping force is based at least partly on the tension force.

15. The vertical rod latching device of claim 14, wherein when the bolt is in the first rotational position, the vertical rod is free to move under force of gravity relative to the vertical rod coupler.

16. The vertical rod latching device of claim 14, wherein the latch includes a biasing member, and wherein when the bolt is in the first rotational position, the vertical rod is free to move under force of the biasing member relative to the vertical rod coupler.

17. The vertical rod latching device of claim 14, wherein the bolt is accessible when the door is movably mounted in a door frame.

18. The vertical rod latching device of claim 14, wherein the vertical rod includes a first portion and a second portion separated by a through channel which extends along a longitudinal axis of the vertical rod.

19. The vertical rod latching device of claim 18, wherein the bracket includes a central portion positioned between a first bracket channel and a second bracket channel, and wherein the first bracket channel and the second bracket channel are configured to receive the first portion and the second portion of the vertical rod, respectively.

20. The vertical rod latching device of claim 19, wherein the central portion is disposed in the through channel, and wherein the bracket through-hole is formed in the central portion.

* * * * *